US009646447B2

(12) United States Patent
Nishino

(10) Patent No.: US 9,646,447 B2
(45) Date of Patent: May 9, 2017

(54) DETERMINATION APPARATUS AND MEDIUM TRANSACTION APPARATUS

(71) Applicant: Oki Electric Industry Co., Ltd., Tokyo (JP)

(72) Inventor: Nobuharu Nishino, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/111,223

(22) PCT Filed: Dec. 10, 2014

(86) PCT No.: PCT/JP2014/082645
§ 371 (c)(1),
(2) Date: Jul. 13, 2016

(87) PCT Pub. No.: WO2015/166607
PCT Pub. Date: Nov. 5, 2015

(65) Prior Publication Data

US 2016/0335825 A1 Nov. 17, 2016

(30) Foreign Application Priority Data

Apr. 28, 2014 (JP) ..... 2014-093006

(51) Int. Cl.
*G07D 11/00* (2006.01)
*G07F 7/04* (2006.01)
(Continued)

(52) U.S. Cl.
CPC ..... *G07D 7/12* (2013.01); *B65H 5/38* (2013.01); *G07D 7/04* (2013.01); *G07D 7/121* (2013.01); *G07D 11/0003* (2013.01)

(58) Field of Classification Search
CPC .. G07D 7/00; G07D 7/04; G07D 7/06; G07D 7/12; G07D 7/164; G07D 11/0003; G07D 11/0021; B65H 5/38
See application file for complete search history.

(56) References Cited

U.S. PATENT DOCUMENTS 4,503,963 A * 3/1985 Steiner ..... G07D 1/04 194/200
2003/0141653 A1* 7/2003 Kumamoto ..... B65H 7/02 271/262

(Continued)

FOREIGN PATENT DOCUMENTS

JP H10-134224 A 5/1998
JP 2003-179726 A 6/2003

(Continued)

*Primary Examiner* — Mark Beauchaine
(74) *Attorney, Agent, or Firm* — Rabin & Berdo, P.C.

(57) ABSTRACT

A determination apparatus includes a first transportation guide, disposed on one side of a conveyance path through which a medium travels when being transported, on which a first transportation surface is formed facing the conveyance path. A sensor, on which a reading surface that reads a state of the medium, is provided closer to a side of the first transportation guide than the conveyance path. A second transportation guide, disposed on another side of the conveyance path facing the first transportation guide across the path, on which a second transportation surface is formed facing the path, on which a space through which the medium is transported, is formed between the first and second transportation guides, and on which a bend part is formed, at a portion facing the reading surface, bent in a direction separating from the reading surface more than a portion not facing the reading surface.

12 Claims, 18 Drawing Sheets

(51) Int. Cl.

| | |
|---|---|
| ***G07D 7/12*** | (2016.01) |
| ***B65H 5/38*** | (2006.01) |
| ***G07D 7/04*** | (2016.01) |

(56) References Cited

U.S. PATENT DOCUMENTS

| | | | | |
|---|---|---|---|---|
| 2006/0186198 | A1 | 8/2006 | Terao et al. | |
| 2008/0251997 | A1 | 10/2008 | Kawasaki et al. | |
| 2010/0000312 | A1* | 1/2010 | Nommer ..... | G07D 11/0003 73/159 |

FOREIGN PATENT DOCUMENTS

| | | | |
|---|---|---|---|
| JP | 2004-210475 | A | 7/2004 |
| JP | 2006-227951 | A | 8/2006 |
| JP | 2012-084059 | A | 4/2012 |
| WO | WO-2012/095910 | A1 | 7/2012 |

* cited by examiner

DETERMINATION APPARATUS AND MEDIUM TRANSACTION APPARATUS

TECHNICAL FIELD

The present invention relates to a determination apparatus and a medium transaction apparatus, and is preferably applied, for example, to an automatic teller machine (ATM) or the like that conducts a desired transaction by accepting a medium such as a bank note.

BACKGROUND ART

Conventionally, automatic teller machines or the like used in financial institutions, shops or the like have accepted cash such as bank notes or coins from customers, and paid out cash to customers, for example, in accordance with transaction contents with the customers.

Some automatic teller machines have, for example, a bank note deposit-withdrawal unit that accepts bank notes from a customer and pays out bank notes to a customer, a determination unit that determines the denominations and authenticity of inserted bank notes, a temporary reservation unit that temporarily reserves inserted bank notes, a transportation unit that transports bank notes, and a bank note storage that stores bank notes for each denomination.

Some determination units internally have a magnetic detection unit that detects magnetic ink attached to bank notes, an optical detection unit that detects images of bank notes, and a thickness detection unit that detects the thickness of bank notes (for example, refer to Patent Literature 1).

CITATION LIST

Patent Literature

Patent Literature 1: JP 2012-84059A

SUMMARY OF INVENTION

Technical Problem

It is desirable for such determination units to enhance the reliability by improving the transportation performance of bank notes, while improving the discrimination performance.

The present invention is devised by considering the above described points, and proposes a determination apparatus and a medium transaction apparatus that can enhance the reliability while improving the discrimination performance.

Solution to Problem

In order to solve the problem, a determination apparatus according to the present invention includes: a one side transportation guide, disposed on one side of a conveyance path through which a medium travels when being transported, on which a one side transportation surface is formed facing the conveyance path; a sensor on which a reading surface that reads a state of the medium is provided closer to a side of the one side transportation guide than the conveyance path; and an other side transportation guide, disposed on another side of the conveyance path facing the one side transportation guide across the conveyance path, on which an other side transportation surface is formed facing the conveyance path, on which a medium transportation space through which the medium is transported is formed between the other side transportation guide and the one side transportation guide, and on which a bend part is formed, at a portion facing the reading surface, bent in a direction separating from the reading surface more than a portion not facing the reading surface.

This determination apparatus can secure a transportation space thickness at a portion facing a reading surface, while bringing a medium close to the reading surface.

A medium transaction apparatus according to the present invention includes: an operation unit that receives an operation related to a paper-sheet shaped medium; a transportation unit that transports the medium; a one side transportation guide, disposed on one side of a conveyance path through which the medium travels when being transported, on which a one side transportation surface is formed facing the conveyance path; a sensor on which a reading surface that reads a state of the medium is provided closer to a side of the one side transportation guide than the conveyance path; and an other side transportation guide, disposed on another side of the conveyance path facing the one side transportation guide across the conveyance path, on which an other side transportation surface is formed facing the conveyance path, on which a medium transportation space through which the medium is transported is formed between the one side transportation guide, and on which a bend part is formed, at a portion facing the reading surface, bent in a direction separating from the reading surface more than a portion not facing the reading surface.

This medium transaction apparatus can secure a transportation space thickness at a portion facing a reading surface, while bringing a medium close to the reading surface.

Advantageous Effects of Invention

According to the present invention, a transportation space thickness can be secured at a portion facing a reading surface, while bringing a medium close to the reading surface. Therefore, the present invention can implement a determination apparatus and a medium transaction apparatus that can enhance the reliability while improving the discrimination performance.

DESCRIPTION OF EMBODIMENTS

Hereinafter, the modes for executing the invention (hereinafter called the embodiments) will be described by using the figures.

1. First Embodiment

1-1. Configuration of the Automatic Teller Machine

Figure 1:
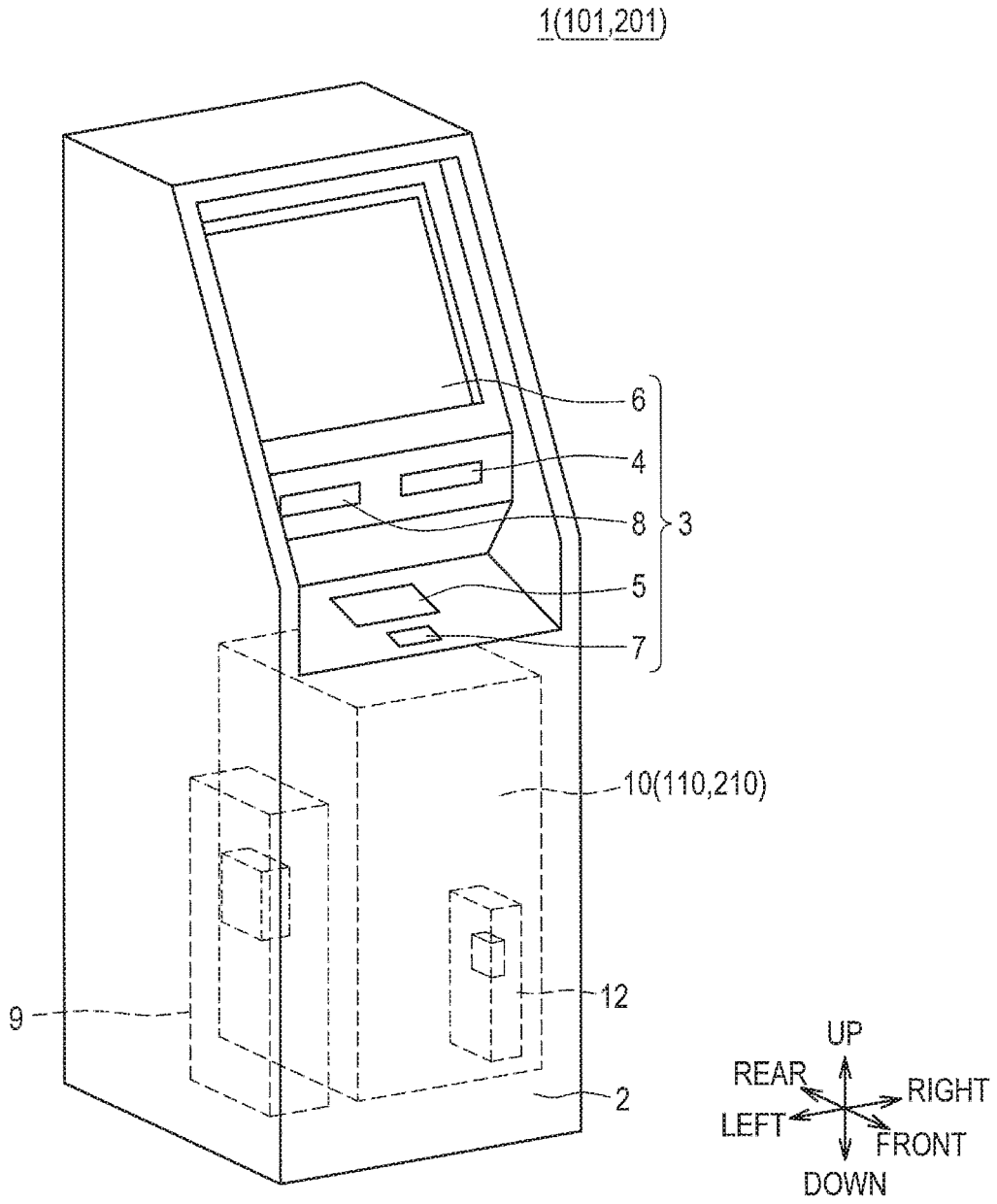
FIG. 1 is a perspective view that shows a configuration of an automatic teller machine.

Like the external appearance as shown in FIG. 1, an automatic teller machine 1 chiefly includes a box-shaped housing 2, is installed, for example, in a financial institution or the like, and performs transactions related to cash, such as a deposit transaction or a withdrawal transaction, with a customer. The housing 2 is provided with a customer service unit 3 at a portion that, for example, facilitates a customer standing in front of the housing 2 to insert bank notes or operate a touch panel.

The customer service unit 3 is provided with a card input-output port 4, a deposit-withdrawal port 5, an operation display unit 6, a numeric keypad 7, and a receipt issue port 8, directly exchanges cash, a bank book or the like with a customer, and accepts notifications of information and operation instructions related to a transaction. The card input-output port 4 is a section where various types of cards, such as a cash card, are inserted or ejected. A card processing unit (not illustrated), which reads an account number or the like magnetically recorded on the various types of cards, is provided on the inner side of the card input-output port 4. The deposit-withdrawal port 5 is a section where bank notes to be deposited by a customer are inserted, and bank notes to be withdrawn by a customer are ejected. Further, the deposit-withdrawal port 5 is opened or closed by driving a shutter. In the operation display unit 6, a liquid crystal display (LCD) that displays an operation screen at the time of a transaction, and a touch panel that is used for making a selection of the type of transaction, and inputting a pin number, a transaction amount or the like are integrated. The numeric keypad 7 includes physical keys that accept an input such as the numerals of "0" to "9", and are used at the time of an input operation such as a pin number or a transaction amount. The receipt issue port 8 is a section that issues a receipt on which the transaction contents or the like are printed at the time of the end of a transaction process. Incidentally, a receipt processing unit (not illustrated), which prints the transaction contents or the like on a receipt, is provided on the inner side of the receipt issue port 8.

A main control unit 9 that integrally controls the entire automatic teller machine 1, a bank note deposit-withdrawal machine 10 that performs various processes related to bank notes, and the like are provided within the housing 2. The main control unit 9 chiefly includes a central processing unit (CPU), which is not illustrated, and controls each of the units and performs various processes such as a deposit transaction or a withdrawal transaction by reading and executing prescribed programs from a storage unit (not illustrated) such as read only memory (ROM), random access memory (RAM), a hard disk drive, or flash memory.

Hereinafter, the side of the automatic teller machine 1 that faces a customer will be defined as a front side, the opposite side to this will be defined as a rear side, and the left and right sides as seen from a customer facing this front side will be respectively defined as a left side and a right side in addition to an upper side and a lower side.

1-2. Internal Configuration of the Bank Note Deposit-Withdrawal Machine

Figure 2:
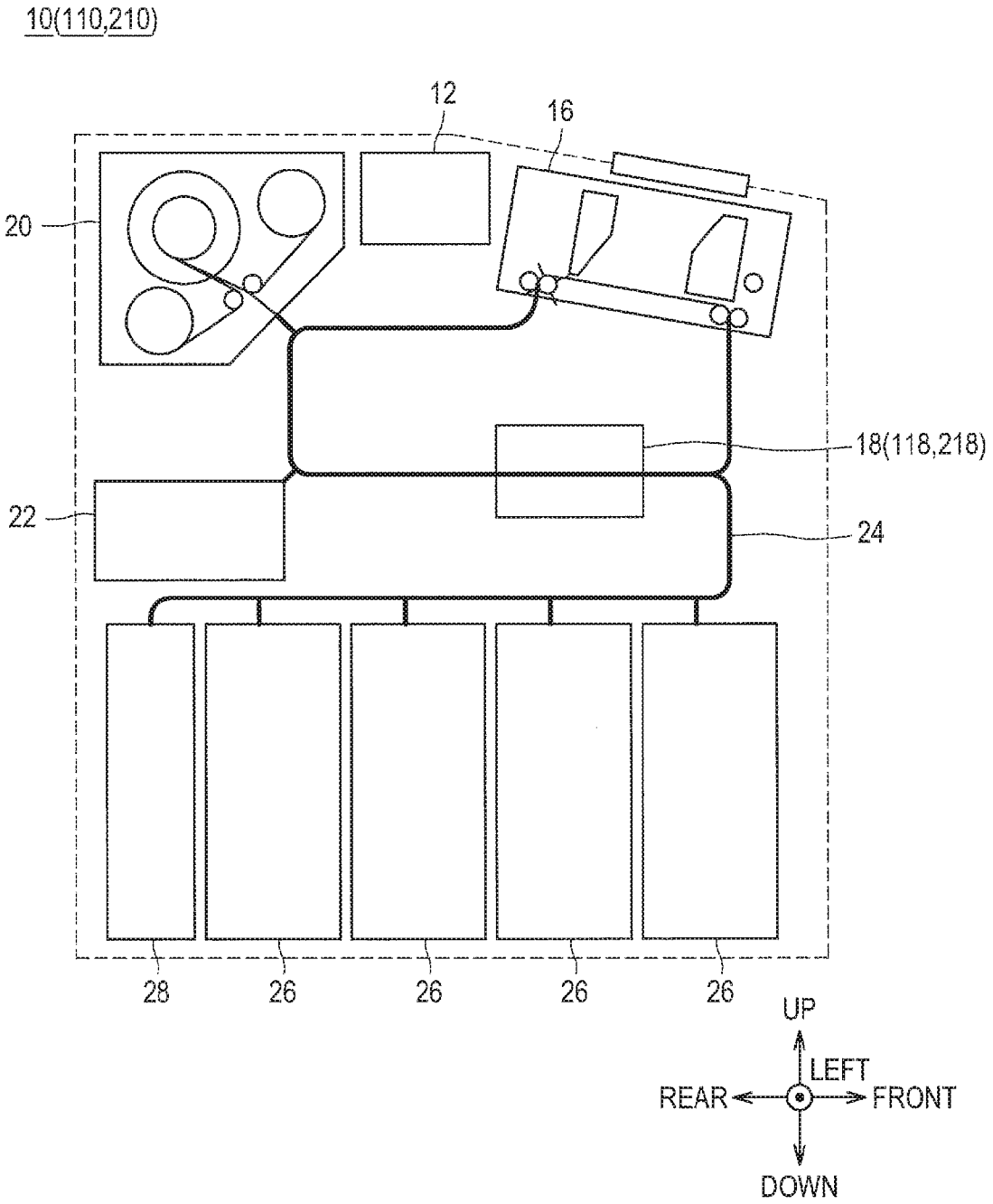
FIG. 2 is a left-side view that shows a configuration of a bank note deposit-withdrawal machine.

As shown in FIG. 2, the bank note deposit-withdrawal machine 10 has a control unit 12 integrally control each of the units (a bank note deposit-withdrawal unit 16, a transportation unit 24, a determination unit 18, a temporary reservation unit 20, bank note storages 26, a rejection storage 28, and a forgotten-bank-note collection storage 22).

The control unit 12 chiefly includes a CPU, which is not illustrated, and controls each of the units to perform various processes such as a deposit transaction or a withdrawal transaction by reading and executing prescribed programs from a storage unit, which is ROM, RAM, a hard disk drive, flash memory or the like.

The bank note deposit-withdrawal unit 16, the determination unit 18 that determines the denominations and authenticity of bank notes, the temporary reservation unit 20 that temporarily reserves deposited bank notes or the like, the forgotten-bank-note collection storage 22 that collects and stores bank notes forgotten by a customer in the bank note deposit-withdrawal unit 16 at the time of a transaction, and the like are provided on the upper side within the bank note deposit-withdrawal machine 10.

The bank note deposit-withdrawal unit 16 dispatches bank notes inserted from a customer to the transportation unit 24 separated one by one. The transportation unit 24 transports the rectangular bank notes in the shorter side direction along a conveyance path shown by the thick line within the figure, by rollers, belts and the like, which are not illustrated. The transportation unit 24 transports the bank notes through the determination unit 18 in the front-rear direction, and connects the rear side of this determination unit 18 to the temporary reservation unit 20, the forgotten-bank-note collection storage 22, and the bank note deposit-withdrawal unit 16. Further, the transportation unit 24 connects the front side of this determination unit 18 to the bank note deposit-withdrawal unit 16, the bank note storages 26, and the rejection storage 28.

The determination unit 18 determines the denominations, authenticity, the degree of damage (soundness), and the like of bank notes by using optical elements, magnetic detection elements or the like, while transporting the bank notes within the determination unit 18, and notifies this determination result to the control unit 12. In accordance with this, the control unit 12 decides the transportation destinations of these bank notes, based on the acquired determination result.

The temporary reservation unit 20 temporarily reserves the bank notes inserted by a customer to the bank note deposit-withdrawal unit 16 at the time of a deposit, and temporarily reserves normal bank notes determined by the determination unit 18 to be acceptable until a deposit is confirmed, while ejecting rejected bank notes determined to be unacceptable to the bank note deposit-withdrawal unit 16 by so-called last-in-first-out.

Further, the bank note storages 26 separated by denominations, and the rejection storage 28 that stores bank notes that have been determined to be damaged bank notes (so-called damaged money) by the determination unit 18, and bank notes of denominations not to be returned such as 5,000 yen and 2,000 yen bill, are provided on the lower side within the bank note deposit-withdrawal machine 10. The bank note storage 26 takes in and stores bank notes transported from the transportation unit 24, and ejects and supplies stored bank notes to the transportation unit 24 by a storage ejection mechanism.

In such a configuration, the automatic teller machine 1 performs a deposit process, a storage process, and a withdrawal process of bank notes by having the main control unit 9 and the control unit 12 control each of the units based on a determination result of the bank notes or the like by the determination unit 18.

That is, when a deposit transaction is selected by a user via the operation display unit 6, and further bank notes are inserted into the deposit-withdrawal port 5 at the time of a deposit transaction, the automatic teller machine 1 transports the inserted bank notes from the bank note deposit-withdrawal unit 16 to the determination unit 18 one by one. Here, the automatic teller machine 1 transports bank notes determined to be acceptable based on a determination result of the determination unit 18 to the temporary reservation unit 20, and temporarily stores the transported bank notes in the temporary reservation unit 20. On the other hand, the automatic teller machine 1 returns bank notes determined to be unsuitable for being accepted to the bank note deposit-withdrawal unit 16, and opens the shutter to return the bank notes to the user. Afterwards, when the amount of money to be deposited is confirmed by the user, the automatic teller machine 1 transports the bank notes stored in the temporary reservation unit 20 to the determination unit 18, and obtains a determination result. Here, the automatic teller machine 1 transports bank notes determined to be storageable based on a determination result of the determination unit 18 to each of the bank note storages 26 in accordance with these denominations, and stores the transported bank notes in each of the bank note storages 26. On the other hand, the automatic teller machine 1 transports bank notes determined to be unsuitable for being stored to the rejection storage 28.

On the other hand, when a withdrawal transaction is selected by a user via the operation display unit 6, and the amount of money to be withdrawn is input at the time of a withdrawal transaction, the automatic teller machine 1 recognizes the number of bank notes of each denomination necessary for the amount of money to be withdrawn, dispatches bank notes from each of the bank note storages 26 in accordance with the number of bank notes of each denomination to be transported to the determination unit 18, and obtains a determination result. Here, the automatic teller machine 1 transports bank notes determined to be payable based on a determination result of the determination unit 18 to the bank note deposit-withdrawal unit 16. On the other hand, the automatic teller machine 1 transports bank notes determined to be unsuitable for being paid out to the temporary reservation unit 20, and temporarily stores the transported bank notes in the temporary reservation unit 20. Then, when bank notes for the amount of money to be withdrawn are accumulated in the bank note deposit-withdrawal unit 16, the automatic teller machine 1 opens the shutter. This makes receivable the bank notes accumulated within the bank note deposit-withdrawal unit 16, and the user receives these bank notes. Afterwards, the automatic teller machine 1 transports the bank notes stored in the temporary reservation unit 20 to the rejection storage 28, and retains the transported bank notes in the rejection storage 28.

1-3. Configuration of the Determination Unit

Figure 3:
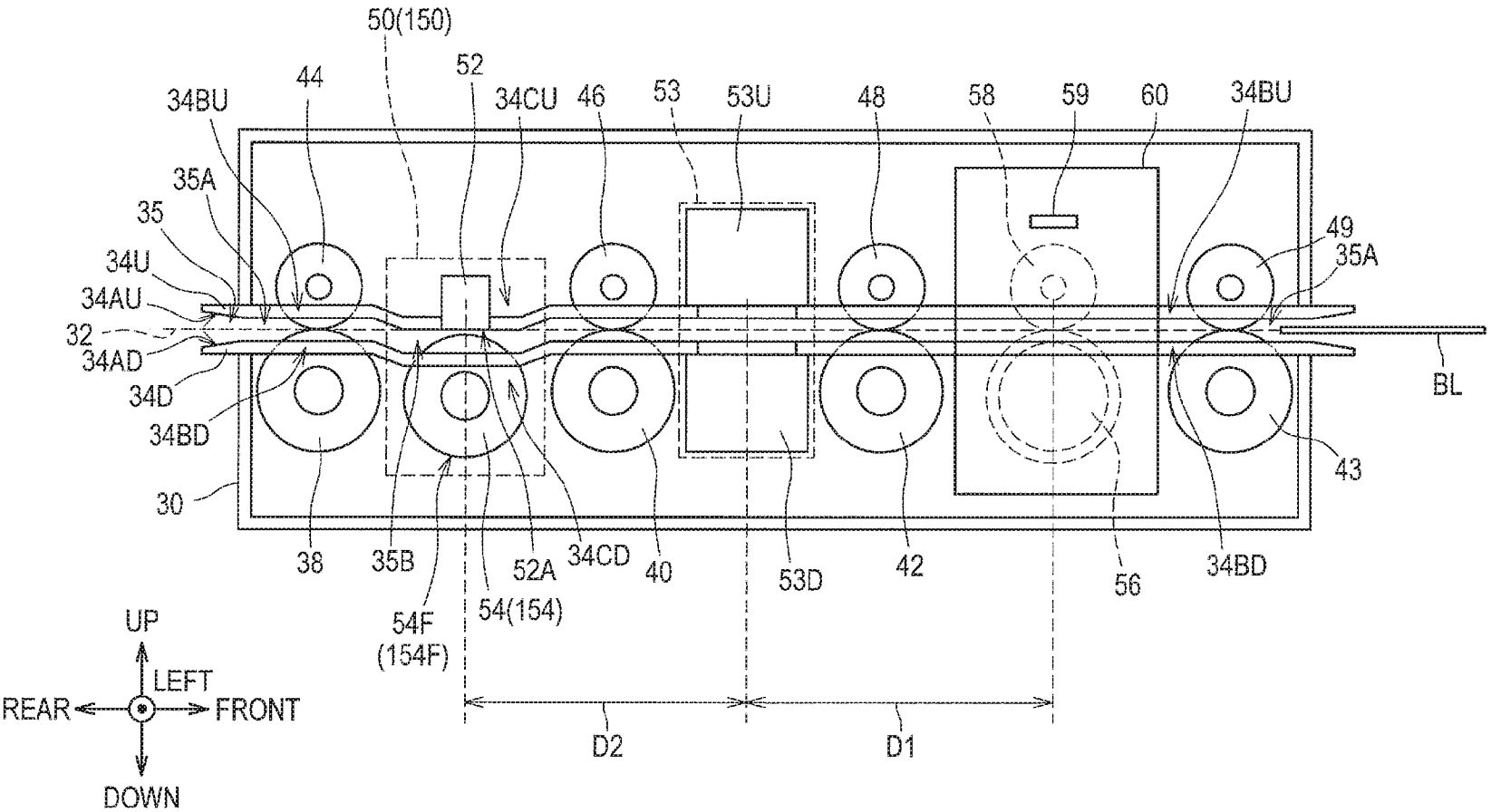
FIG. 3 is a left-side view that shows a configuration of a determination unit according to first and second embodiments.

As shown in FIG. 3, the determination unit 18 performs a determination process of bank notes based on a control of the control unit 12, while causing these bank notes to travel in a front direction or a rear direction along an approximately horizontal conveyance path 32 within a rectangular-parallelepiped determination unit housing 30. Incidentally, for the sake of convenience, FIG. 3 schematically represents each of the internal parts by omitting a left-side plate or the like of the determination unit housing 30.

The conveyance path 32 is constituted by an upper side transportation guide 34U and a lower side transportation guide 34D, driving rollers 38, 40, 42, and 43, driven rollers 44, 46, 48, and 49, a standard roller 56, a thickness detection roller 58, and a magnetic gap roller 54. The driving rollers 38, 40, 42, and 43 and the magnetic gap roller 54 are constituted by rubber-based elastic members, and have a high frictional force with respect to a bank note. The driven rollers 44, 46, 48, and 49 and the thickness detection roller 58 are constituted by metallic, resin, or rubber-based elastic members, or combinations of these. Further, the standard roller 56 is made of a prescribed metallic material.

The upper side transportation guide 34U and the lower side transportation guide 34D respectively have a planar upper side transportation surface 34AU and a planar lower side transportation surface 34AD facing the paper surface of a bank note BL, and form a bank note transportation space 35 through which a bank note travels between the transportation surfaces. The upper side transportation guide 34U is formed with an upper side straight-line part 34BU extending in an approximate straight line along a horizontal direction, and an upper side bend part 34CU bent downward in the vicinity of the magnetic sensor 52. The lower side transportation guide 34D is formed with a lower side straight-line part 34BD extending in an approximate straight line along a horizontal direction, and a lower side bend part 34CD bent downward in the vicinity of the magnetic sensor 52. In this way, the bank note transportation space 35 is formed with a transportation space straight-line part 35A enclosed by the upper side straight-line part 34BU and the lower side straight-line part 34BD and extending in an approximate straight line along a horizontal direction, and a transportation space bend part 35B enclosed by the upper side bend part 34CU and the lower side bend part 34CD and bent downward in the vicinity of the magnetic sensor 52.

Further, the determination unit 18 has the driving roller 43 and the driven roller 49, a thickness detection unit 60, the driving roller 42 and the driven roller 48, an optical detection unit 53, the driving roller 40 and the driven roller 46, the magnetic sensor 52, and the driving roller 38 and the driven roller 44 sequentially arranged in the determination unit housing 30 from the front side to the rear side. The driving roller 43 and the driven roller 49, the driving roller 42 and the driven roller 48, the driving roller 40 and the driven roller 46, and the driving roller 38 and the driven roller 44 are arranged so that the distances of the front-rear direction are shorter than the length of the shorter side direction of a bank note. Further, the optical detection unit 53 and the thickness detection unit 60 are arranged so that the distance between the detection units becomes a distance D1 between the optical detection unit and thickness detection unit, and the optical detection unit 53 and the magnetic detection unit 50 are arranged so that the distance between the detection units becomes a distance D2 between the optical detection unit and magnetic detection unit.

The driving rollers 38, 40, 42, and 43, the standard roller 56, and the magnetic gap roller 54 are rotatably attached to the lower side transportation guide 34D, so that a center axis faces a left-right direction, that is, a direction orthogonal to the transportation direction of the bank note BL. Further, the driving rollers 38, 40, 42, and 43, the standard roller 56, and the magnetic gap roller 54 each have a part of the outer peripheral surface exposed on the side of the conveyance path 32 from the lower side transportation guide 34D through a hole part bored into the lower side transportation surface 34AD. In addition, the driving rollers 38, 40, 42, and 43, the standard roller 56, and the magnetic gap roller 54 are actively rotated by a driving force transmitted from an actuator, which is not illustrated.

On the other hand, the driven rollers 44, 46, 48, and 49, and the thickness detection roller 58 are rotatably attached with a center axis facing a left-right direction, and movably attached, in an up-down direction, at portions facing the driving rollers 38, 40, 42, and 43, and the standard roller 56 on the upper side transportation guide 34U. Further, the driven rollers 44, 46, 48, and 49, and the thickness detection roller 58 are respectively pushed towards the driving rollers 38, 40, 42, and 43, and the standard roller 56 by compression springs, which are not illustrated. Accordingly, in the case where the bank note BL is transported along the conveyance path 32, the driven rollers 44, 46, 48, and 49, and the thickness detection roller 58 will respectively push this bank note BL towards the driving rollers 38, 40, 42, and 43, and the standard roller 56. The driving rollers 38, 40, 42, and 43, and the standard roller 56 transport this bank note BL in a front-rear direction along the conveyance path 32 by transmitting a rotational force to the bank note BL.

A displacement sensor 59 is provided above the thickness detection roller 58 of the thickness detection unit 60. The displacement sensor 59 detects a relative displacement amount of the thickness detection roller 58, based on the position at the time when the thickness detection roller 58 is in contact with the standard roller 56. The determination unit 18 determines whether the displacement amount corresponds to one bank note or a plurality of bank notes, by comparing this detection result and a standard value of the thickness stored beforehand, and determines the presence/absence of bending, adhesion of foreign bodies or the like.

By such a configuration, in the thickness detection unit 60, in the case where nothing is transported on the conveyance path 32, the thickness detection roller 58 will be brought into contact with the standard roller 56 by the operation of the compression springs. In this way, the thickness detection roller 58 receives a rotational and driving force transmitted from the standard roller 56, and rotates according to the rotation of this standard roller 56. At this time, the thickness detection unit 60 detects that the thickness detection roller 58 is positioned at a height that becomes a standard, by the displacement sensor 59. On the other hand, in the thickness detection unit 60, in the case where the bank note BL is transported on the conveyance path 32, this bank note BL will be held between the thickness detection roller 58 and the standard roller 56, so that the thickness detection roller 58 will be displaced in an up direction in accordance with the thickness of this bank note BL. At this time, the thickness detection unit 60 detects the displacement amount of the thickness detection roller 58 by the displacement sensor 59.

The optical detection unit 53 is constituted by an upper side reflection-transmission sensor unit 53U and a lower side reflection-transmission sensor unit 53D.

The upper side reflection-transmission sensor unit 53U emits prescribed irradiation light towards the down direction, and receives reflected light, which is a part of this irradiation light reflected on the upper side surface of the bank note BL. This reflected light represents a reflection pattern of light on the upper side of the bank note BL. Further, the upper side reflection-transmission sensor unit 53U emits prescribed irradiation light towards the down direction, and the lower side reflection-transmission sensor unit 53D receives transmitted light, which is a part of this irradiation light, through the bank note BL. This transmitted light represents a transmission pattern of light from the upper side to the lower side on the bank note BL.

The lower side reflection-transmission sensor unit 53D emits prescribed irradiation light towards the up direction, and receives reflected light, which is a part of this irradiation light reflected on the lower side surface of the bank note BL. This reflected light represents a reflection pattern of light on the lower side of the bank note BL. Further, the lower side reflection-transmission sensor unit 53D emits prescribed irradiation light towards the up direction, and the upper side reflection-transmission sensor unit 53U receives transmitted light, which is a part of this irradiation light, through the bank note BL. This transmitted light represents a transmission pattern of light BL from the lower side to the upper side on the bank note.

By such a configuration, the optical detection unit 53 detects a reflection pattern and a transmission pattern of the bank note BL, and the determination unit 18 determines the authenticity, denomination, the degree of damage (soundness) or the like of this bank note BL by using the reflection pattern and the transmission pattern of the bank note BL acquired from the optical detection unit 53.

In the magnetic detection unit 50, the magnetic sensor 52 is arranged on the upper side of the conveyance path 32. The magnetic gap roller 54 is disposed by slightly leaving a clearance between a magnetic gap roller outer peripheral surface 54F, which is the outer peripheral surface of this roller, and a magnetic sensor reading surface 52A, which is the surface detecting magnetism which the magnetic sensor 52 has. The bank note BL is printed by using magnetic ink locally having magnetism. Accordingly, the magnetic detection unit 50 detects magnetism of the bank note BL transported on the conveyance path 32, by the magnetic sensor 52. The determination unit 18 determines the authenticity, denomination or the like of the bank note by using a magnetic detection result of the bank note BL acquired from the magnetic detection unit 50.

1-4. Configuration of the Magnetic Detection Unit

Figure 4:
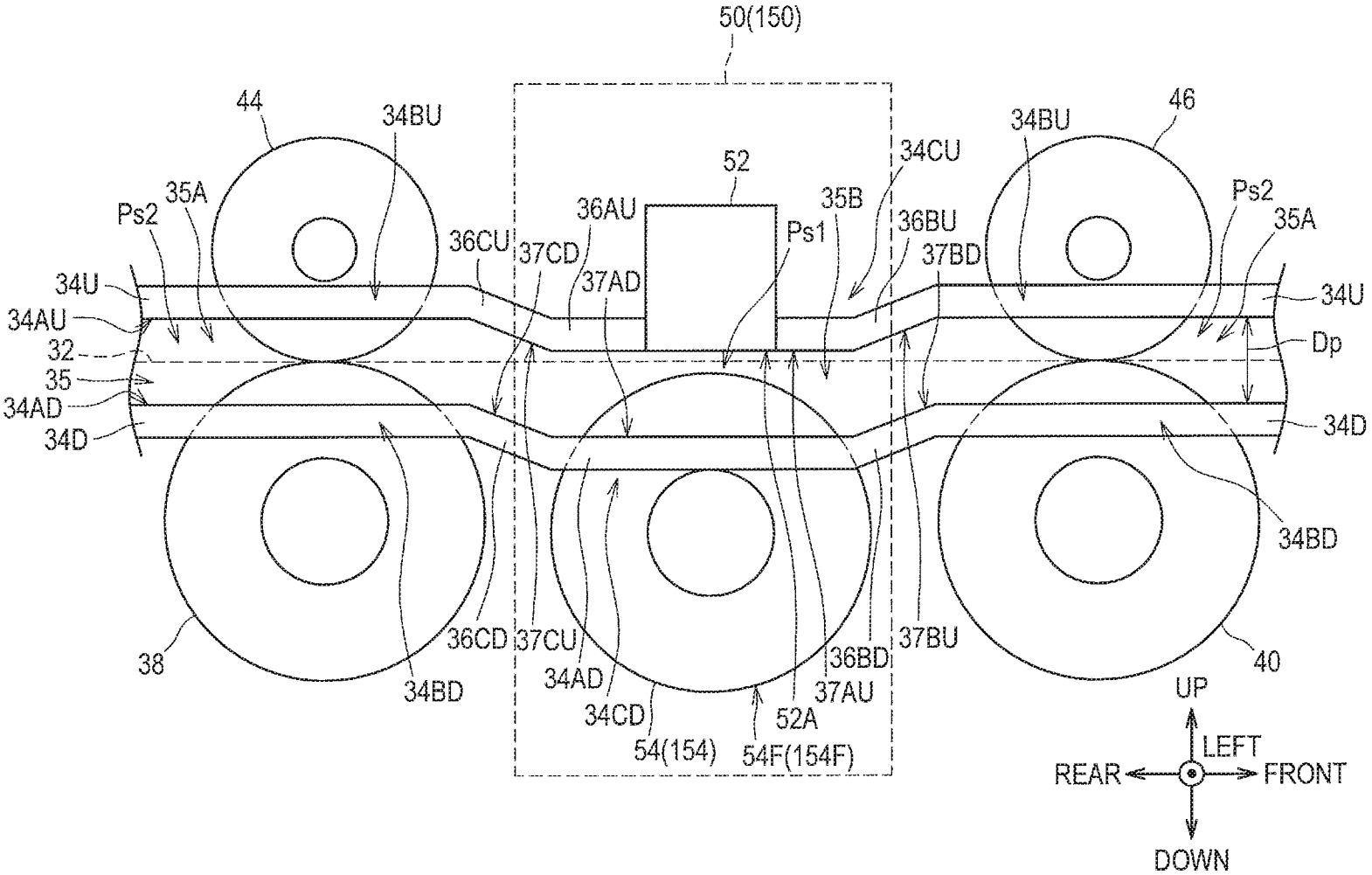
FIG. 4 is a left-side view that shows a configuration (1) of a magnetic detection unit.
Figure 5:
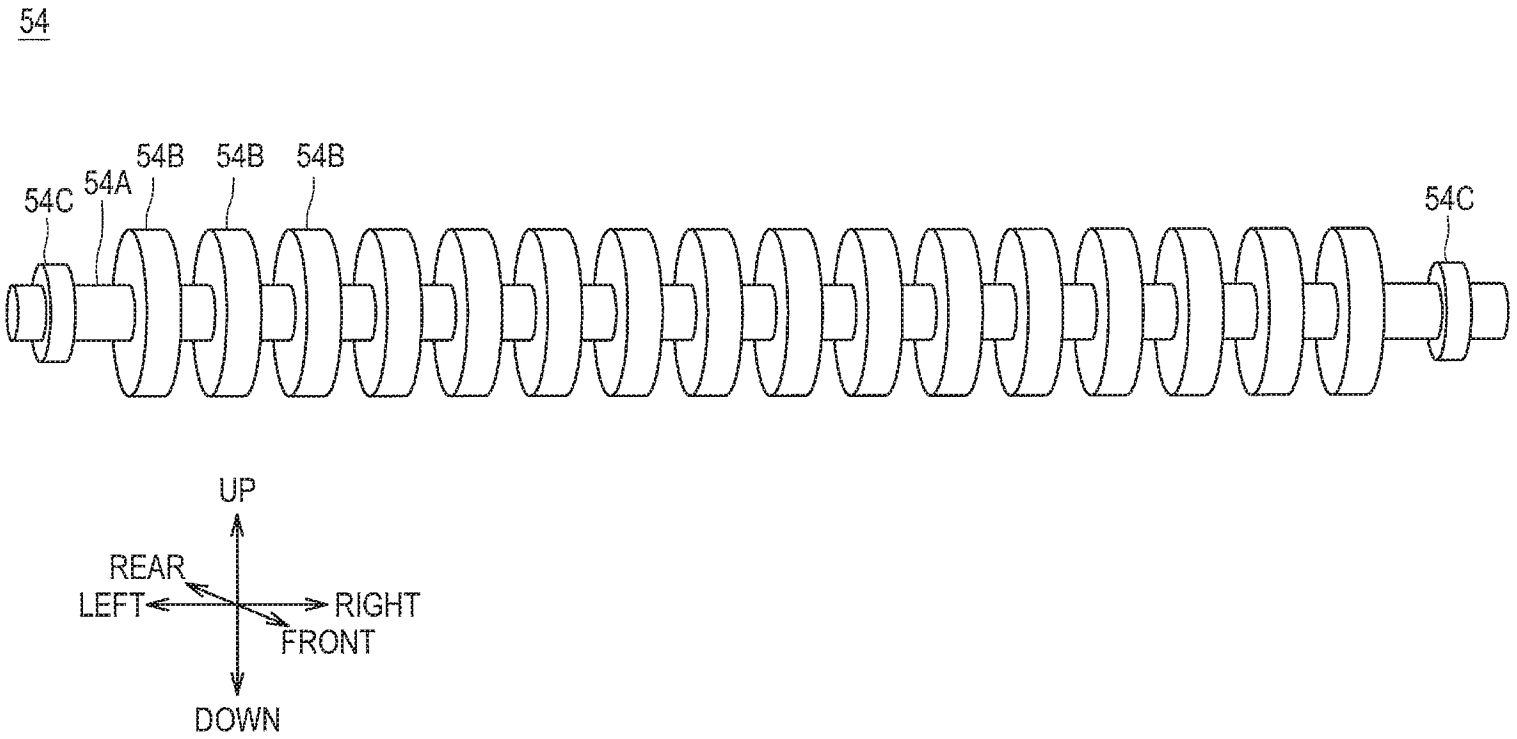
FIG. 5 is a perspective view that shows a configuration of a magnetic gap roller according to the first embodiment.

As shown in FIG. 4, the magnetic sensor 52 is attached to the determination unit housing 30 with the magnetic sensor reading surface 52A exposed from the upper side transportation surface 34AU. As shown in FIG. 5, the magnetic gap roller 54 is constituted by having a plurality of cylindrical rollers 54B, which are rubber-based elastic members such as vulcanized rubber, for example, and a rotating shaft 54C capable of rotating with a center axis facing a left-right direction, attached to a shaft 54A made of a non-magnetic material such as an austenitic stainless steel.

The magnetic gap roller 54 is movably attached, in an up-down direction, to the lower side transportation guide 34D facing the magnetic sensor reading surface 52A, so as to be in contact with and separate from this magnetic sensor reading surface 52A. In the magnetic gap roller 54, the rotating shaft 54C is pushed towards the upper side by compression springs, which are not illustrated, and the rotating shaft 54C is abutting a limiter (not illustrated) provided on the determination unit housing 30 or the magnetic detection unit 50, so that the clearance between the magnetic gap roller outer peripheral surface 54F, which is the outer peripheral surface of the roller 54B, and the magnetic sensor reading surface 52A becomes approximately 0.2 to 0.5 mm (approximately two to five times as thick as a bank note).

In the upper side transportation guide 34U, a planar upper side horizontal part 36AU is formed extending in a horizontal direction from the front of a front-end up to the rear of a rear-end of the magnetic sensor reading surface 52A, and an upper side horizontal surface 37AU is formed at the portion facing the bank note transportation space 35 on this upper side horizontal part 36AU, at a sensor reading surface arrangement position Ps1 where the magnetic sensor reading surface 52A of the magnetic sensor 52 is positioned in the front-rear direction, so as to be positioned closer to the lower side than a sensor reading surface non-arrangement position Ps2 (that is, the upper side straight-line part 34BU) where the magnetic sensor reading surface 52A is not positioned.

A planar upper side rear inclination part 36CU inclined towards the upper side straight-line part 34BU is formed, from the rear-end of the upper side horizontal part 36AU, and an upper side rear inclination surface 37CU is formed at the portion facing the bank note transportation space 35 on this upper side rear inclination part 36CU.

A planar upper side front inclination part 36BU inclined towards the upper side straight-line part 34BU is formed, from the front-end of the upper side horizontal part 36AU, and an upper side front inclination surface 37BU is formed at the portion facing the bank note transportation space 35 on this upper side front inclination part 36BU.

In the lower side transportation guide 34D, a planar lower side horizontal part 36AD is formed extending in a horizontal direction from the front of a front-end to the rear of a rear-end of the magnetic sensor reading surface 52A, and facing the upper side horizontal part 36AU so that a distance Dp between transportation surfaces, which is a distance between the upper side transportation surface 34AU and the lower side transportation surface 34AD, becomes equal to that at the sensor reading surface non-arrangement position Ps2, and a lower side horizontal surface 37AD is formed at the portion facing the bank note transportation space 35 on this lower side horizontal part 36AD, at the sensor reading surface arrangement position Ps1, so as to be positioned on the lower side than the sensor reading surface non-arrangement position Ps2, and separated from the magnetic sensor reading surface 52A.

A planar lower side rear inclination part 36CD inclined towards the lower side straight-line part 34BD is formed, from the rear-end of the lower side horizontal part 36AD, facing the upper side rear inclination part 36CU so that the distance Dp between transportation surfaces becomes equal to that at the transportation space straight line part 35A, and a lower side rear inclination surface 37CD is formed at the portion facing the bank note transportation space 35 on this lower side rear inclination part 36CD.

A planar lower side front inclination part 36BD inclined towards the lower side straight-line part 34BD is formed, from the front-end of the lower side horizontal part 36AD, facing the upper side front inclination part 36BU so that the distance Dp between transportation surfaces becomes equal to that at the transportation space straight line part 35A, and a lower side front inclination surface 37BD is formed at the portion facing the bank note transportation space 35 on this lower side front inclination part 36BD.

An upper side bend part 34CU is formed by the upper side horizontal part 36AU, the upper side front inclination part 36BU, and the upper side rear inclination part 36CU, and a lower side bend part 34CD is formed by the lower side horizontal part 36AD, the lower side front inclination part 36BD, and the lower side rear inclination part 36CD. Further, a transportation space bend part 35B is formed by the upper side bend part 34CU and the lower side bend part 34CD. Further, the distance Dp between transportation surfaces is maintained approximately constant at both the sensor reading surface non-arrangement position Ps2 and the sensor reading surface arrangement position Ps1.

Incidentally, since a bank note is transported by being held by the driving roller 38 and the driven roller 44, and the driving roller 40 and the driven roller 46, the conveyance path 32 on which the bank note travels will be on an extension line of a straight line connecting a tangent to the outer peripheral surfaces of the driving roller 38 and the driven roller 44 at the portions where the driving roller 38 and the driven roller 44 are in contact, and a tangent to the outer peripheral surfaces of the driving roller 40 and the driven roller 46 at the portions where the driving roller 40 and the driven roller 46 are in contact. More specifically, the conveyance path 32 is on a straight line connecting a tangent to the upper end part of the outer peripheral surface of the driving roller 38, which is the contact point between the actively rotating driving roller 38 and the bank note, and a tangent to the upper end part of the outer peripheral surface of the driving roller 40, which is the contact point between the driving roller 40 and the bank note.

Here, the upper side transportation guide 34U has a concave shape, at the sensor reading surface arrangement position Ps1, so that a gap between the conveyance path 32 and the upper side transportation surface 34AU is narrower than that at the sensor reading surface non-arrangement position Ps2, and the upper side transportation surface 34AU is closer to the conveyance path 32, and the lower side transportation guide 34D has a convex shape, at the sensor reading surface arrangement position Ps1, so that a gap between the conveyance path 32 and the lower side transportation surface 34AD is wider than that at the sensor reading surface non-arrangement position Ps2, and the lower side transportation surface 34AD is separated from the conveyance path 32.

Accordingly, the conveyance path 32 is positioned, in the approximate center of the up-down position of the bank note transportation space 35, at the sensor reading surface non-arrangement position Ps2, and in the approximate upper end of the up-down position of the bank note transportation space 35, at the sensor reading surface arrangement position Ps1. Further, the magnetic sensor 52 is provided slightly separated from the conveyance path 32 more than the upper side horizontal surface 37AU, so that the magnetic sensor reading surface 52A does not project into the bank note transportation space 35.

In this way, the magnetic detection unit 50 can cause the bank note BL to pass through the vicinity of the magnetic sensor reading surface 52A of the magnetic sensor 52, and can improve a Signal/Noise (S/N) ratio.

1-5. Discrimination Process

Figure 6:
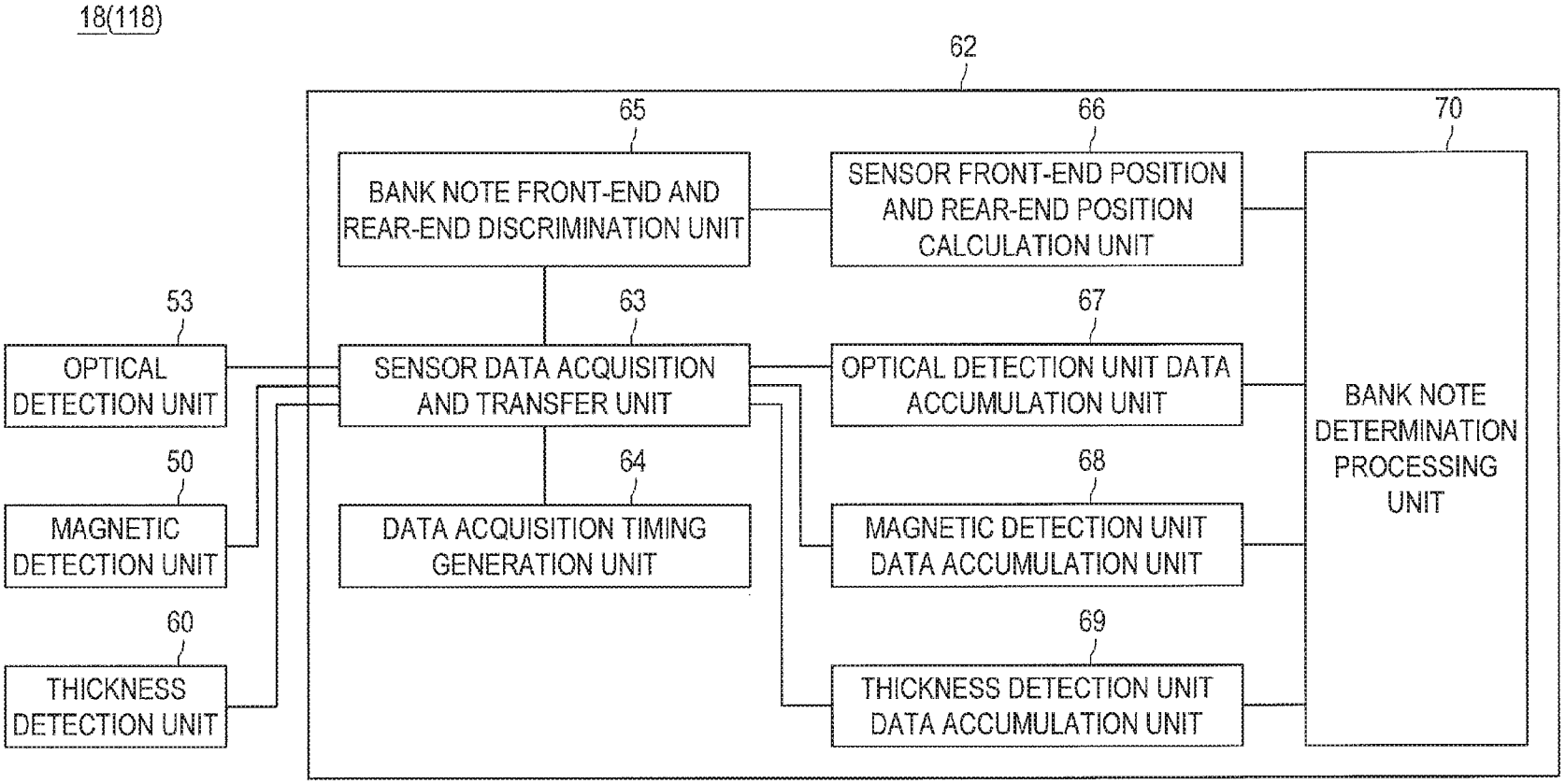
FIG. 6 is a block diagram that shows a function configuration of the determination unit according to the first and second embodiments.

As shown in FIG. 6, the determination unit 18 integrally controls all of the units by a determination control unit 62, and performs a discrimination process for discriminating a bank note. As shown in FIG. 6, the determination control unit 62 is constituted by a sensor data acquisition and transfer unit 63, a data acquisition timing generation unit 64 that is connected to a motor rotation signal and driving roller rotation detection sensor, which is not illustrated, and generates timing information which shows a prescribed timing to acquire bank note information, an optical detection unit data accumulation unit 67 that annularly accumulates data of the optical detection unit 53, which is a ring buffer, a magnetic detection unit data accumulation unit 68 that annularly accumulates data of the magnetic detection unit 50, which is a ring buffer, a thickness detection unit data accumulation unit 69 that annularly accumulates data of the thickness detection unit 60, which is a ring buffer, a bank note front-end and rear-end discrimination unit 65, a sensor front-end position and rear-end position calculation unit 66 that calculates the positions of the front-end and the rear-end of the bank note in the thickness detection unit 60 and the magnetic detection unit 50, and a bank note determination processing unit 70.

The sensor data acquisition and transfer unit 63 acquires timing information from the data acquisition timing generation unit 64, acquires data from the optical detection unit 53, the magnetic detection unit 50, and the thickness detection unit 60 at a timing shown by this timing information, and respectively transfers the acquired data to the optical detection unit data accumulation unit 67, the magnetic detection unit data accumulation unit 68, and the thickness detection unit data accumulation unit 69. Further, the sensor data acquisition and transfer unit 63 transfers data of the optical detection unit 53 to the bank note front-end and rear-end discrimination unit 65.

The bank note front-end and rear-end discrimination unit 65 successively implements a discrimination of the front-end or the rear-end of the bank note, based on data of the optical detection unit 53 acquired from the sensor data acquisition and transfer unit 63, and sends a discrimination result to the sensor front-end position and rear-end position calculation unit 66 as an optical bank note position discrimination result.

The sensor front-end position and rear-end position calculation unit 66 calculates the positions of the front-end and the rear-end of the bank note in the magnetic detection unit 50 and the thickness detection unit 60, based on the optical bank note position discrimination result acquired from the bank note front-end and rear-end discrimination unit 65, and sends a calculation result to the bank note determination processing unit 70 together with the optical bank note position discrimination result as a magnetic thickness bank note position calculation result.

The bank note determination processing unit 70 recognizes the positions of the front-end and the rear-end of the bank note in the optical detection unit 53, the magnetic detection unit 50 and the thickness detection unit 60, by acquiring the optical bank note position discrimination result and the magnetic thickness bank note position calculation result, from the sensor front-end position and rear-end position calculation unit 66. Further, the bank note determination processing unit 70 reads data from the front-end up to the rear-end of the bank note, from the optical detection unit data accumulation unit 67, the magnetic detection unit data accumulation unit 68, and the thickness detection unit data accumulation unit 69, and additionally reads data from the front-end of the bank note up to the rear-end of the bank note that has already passed through, from the magnetic detection unit data accumulation unit 68 and the thickness detection unit data accumulation unit 69. The bank note determination processing unit 70 determines the denomination, authenticity, the degree of damage (soundness), and the like of the bank note, by comparing bank note information of the entire surface of the bank note in the optical detection unit 53, and bank note information taking a difference between a state where there is no bank note and the entire surface of the bank note in the thickness detection unit 60 and the magnetic detection unit 50, with a standard value stored beforehand, and notifies this determination result to the control unit 12.

In such a configuration, the sensor data acquisition and transfer unit 63 successively transfers the acquisition data of the thickness detection unit 60 to the thickness detection unit data accumulation unit 69, the acquisition data of the optical detection unit 53 to the optical detection unit data accumulation unit 67 and the bank note front-end and rear-end discrimination unit 65, and the acquisition data of the magnetic detection unit 50 to the magnetic detection unit data accumulation unit 68, at a timing generated in the data acquisition timing generation unit 64.

Figure 7:
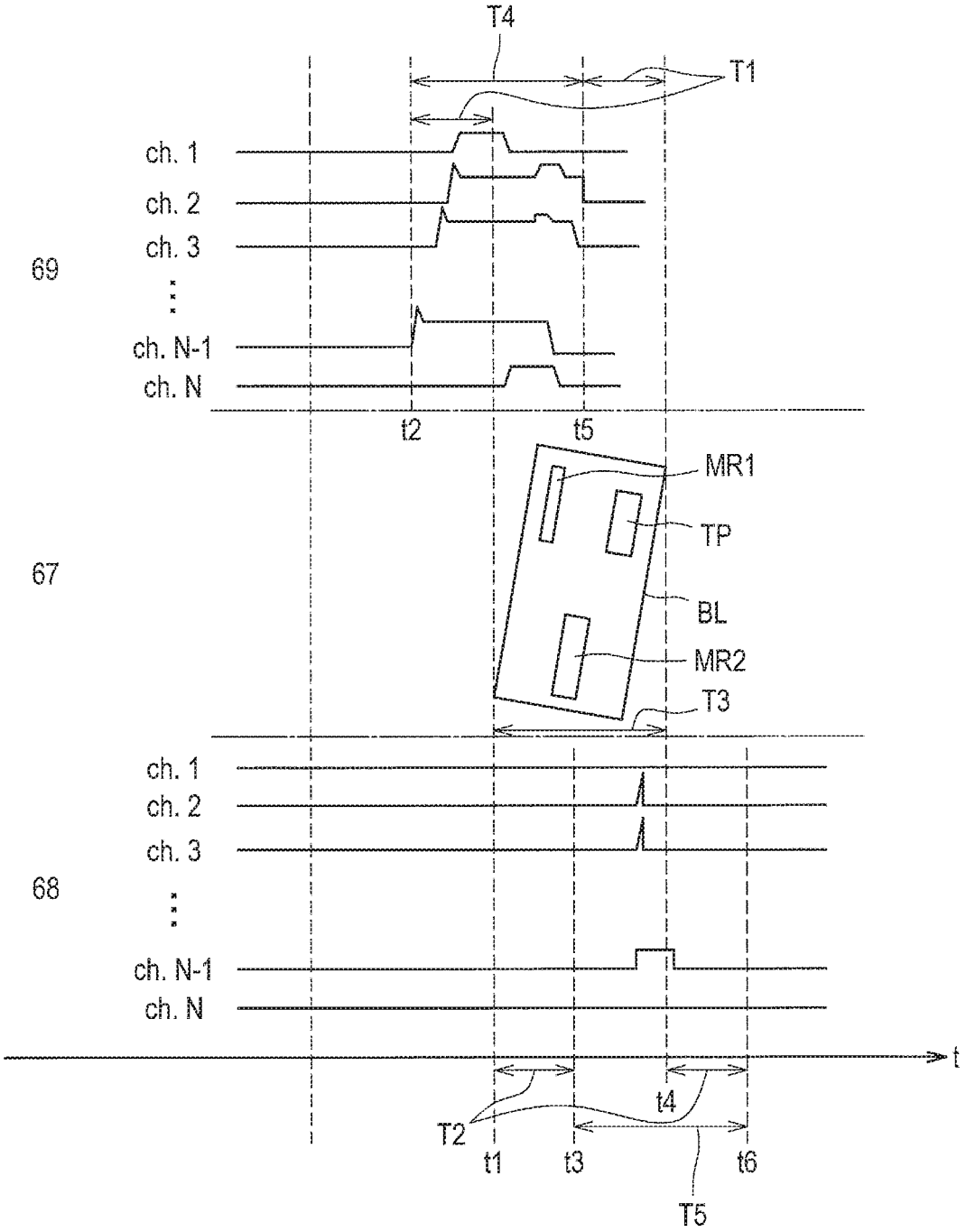
FIG. 7 is a schematic diagram that shows sensor reading timings according to the first and second embodiments.

The bank note front-end and rear-end discrimination unit 65 sets a timing at which the bank note front-end has been slightly detected within the data of the optical detection unit 53 as an optical detection unit front-end timing t1 shown in FIG. 7, and sends information showing this optical detection unit front-end timing t1 to the sensor front-end position and rear-end position calculation unit 66.

The sensor front-end position and rear-end position calculation unit 66 calculates a timing at which the time is shifted by a time T1 between the optical detection unit and thickness detection unit, which is a time at which a distance D1 between the optical detection unit and thickness detection unit (FIG. 3) is converted into a data acquisition timing, and a timing at which the time is shifted by a time T2 between the optical detection unit and magnetic detection unit, which is a time at which a distance D2 between the optical detection unit and magnetic detection unit is converted into a data acquisition timing, with respect to the optical detection unit front-end timing t1, respectively sets the respective timings as a thickness detection unit front-end timing t2 and a magnetic detection unit front-end timing t3, and sends information showing the optical detection unit front-end timing t1, the thickness detection unit front-end timing t2, and the magnetic detection unit front-end timing t3 to the bank note determination processing unit 70.

Further, the bank note front-end and rear-end discrimination unit 65 sets a timing at which the bank note BL is additionally transported, and the bank note initially runs out, after the bank note front-end has been slightly detected within the data of the optical detection unit 53, as an optical detection unit rear-end timing t4, and sends information showing this optical detection unit rear-end timing t4 to the sensor front-end position and rear-end position calculation unit 66.

The sensor front-end position and rear-end position calculation unit 66 calculates a timing at which the time is shifted by the time T1 between the optical detection unit and thickness detection unit, and a timing at which the time is shifted by the time T2 between the optical detection unit and magnetic detection unit, with respect to the optical detection unit rear-end timing t4, respectively sets the respective timings as a thickness detection unit rear-end timing t5 and a magnetic detection unit rear-end timing t6, and sends information showing the optical detection unit rear-end timing t4, the thickness detection unit rear-end timing t5, and the magnetic detection unit rear-end timing t6 to the bank note determination processing unit 70.

The bank note determination processing unit 70 reads data of an optical detection unit data acquisition time period T3, which is a time period from the optical detection unit front-end timing t1 to the optical detection unit rear-end timing t4, from the optical detection unit data accumulation unit 67, reads data of a thickness detection unit data acquisition time period T4, which is a time period from the thickness detection unit front-end timing t2 to the thickness detection unit rear-end timing t5, from the thickness detection unit data accumulation unit 69, reads data of a magnetic detection unit data acquisition time period T5, which is a time period from the magnetic detection unit front-end timing t3 to the magnetic detection unit rear-end timing t6, from the magnetic detection unit data accumulation unit 68, and performs a discrimination process of the bank note.

In FIG. 7, the bank note BL to which a tape TP has been affixed is shown, and the bank note BL to which this tape TP and magnetically-responsive portions MR1 and MR2, which are magnetically-responsive portions, are attached is retained in the optical detection unit data accumulation unit 67 as an image. Further, data from which the thickness of the bank note BL and the thickness of the tape TP are detected is retained in the thickness detection unit data accumulation unit 69, and data from which the magnetically-responsive portions MR1 and MR2 are detected is retained in the magnetic detection unit data accumulation unit 68. Incidentally, the channels (ch) in FIG. 7 correspond to a plurality of the displacement sensors 59 and the magnetic sensors 52 arranged in a left-right direction.

In this way, the determination unit 18 calculates a timing at which a bank note travels through the thickness detection unit 60 and the magnetic detection unit 50, based on data of the optical detection unit 53, and acquires bank note information of the bank note in the thickness detection unit 60 and the magnetic detection unit 50, based on this timing.

Accordingly, the determination unit 18 can match, with a high accuracy, the position of a feature of a reflection pattern or a transmission pattern, such as a picture, a character, or a serial number of the bank note acquired by the optical detection unit 53, the positions of the magnetically-responsive portions MR1 and MR2 of the bank note acquired by the magnetic detection unit 50, and the position where there exists a thickness of the bank note acquired by the thickness detection unit 60. For example, the determination unit 18 can match, with a high accuracy, the position of a reflection pattern or a transmission pattern, such as the portion where the tape TP has been adhered to the bank note acquired by the optical detection unit 53, with a slight difference of color with respect to the portion where the tape TP has not been adhered, and the position of a thickness output of the bank note acquired by the thickness detection unit 60, and can perform a discrimination process with a high accuracy.

Further, in a conventional determination unit, an entry detection sensor is provided for detecting that a bank note has entered the determination unit, and the bank note is detected by a thickness detection unit, an optical detection unit, and a magnetic detection unit after a prescribed delay has been applied from when this entry detection sensor detects the bank note.

In contrast to this, since the determination unit 18 calculates a timing at which the bank note travels through the thickness detection unit 60 and the magnetic detection unit 50, based on data of the optical detection unit 53, and acquires bank note information of the bank note from the thickness detection unit 60 and the magnetic detection unit 50, based on this timing, a detection timing of the bank note is set in the thickness detection unit 60 and the magnetic detection unit 50 positioned on the upstream side of the transportation direction of the bank note more than the optical detection unit 53, by going back from the timing at which the bank note is detected by the optical detection unit 53. In this way, the determination unit 18 can omit the entry detection sensor, and can reduce the number of members.

Note that, while a description has been made heretofore for an operation in the case where a bank note is transported from the front side towards the rear side, in the case where a bank note is transported from the rear side towards the front side, the determination unit 18 reverses the direction of time at which the timing is shifted or the like, and performs similar processes to those described above.

1-6. Operation and Effect

In the above description, in the case where a deposit process is performed, a driving force is transmitted from an actuator, which is not illustrated, to the driving rollers 38, 40, 42, and 43, and the standard roller 56. When the bank note BL is transported from the front side to the determination unit 18, the bank note BL is caught between the driving roller 43 and the driven roller 49, the driven roller 49 pushes the bank note BL against the driving roller 43 to transmit a driving force to the rear direction, and the bank note BL moves in the rear direction to be transported to the thickness detection unit 60.

The bank note BL pushes up the thickness detection roller 58 by the driving force, and the bank note BL is caught between the standard roller 56 and the thickness detection roller 58. The displacement sensor 59 detects the displacement amount of the thickness detection roller 58. Further, the bank note BL is pushed in a down direction towards the standard roller 56 by the thickness detection roller 58, and the driving force in the rear direction is transmitted.

The bank note BL is transported in the rear direction by the driving force from the standard roller 56 and the thickness detection roller 58, pushes up the driven roller 48 in an up direction, and the bank note BL is caught between the driving roller 42 and the driven roller 48. The bank note BL is pushed in a down direction towards the driving roller 42 by the driven roller 48, and the driving force in the rear direction is transmitted.

The bank note BL is transported to the optical detection unit 53 by the driving force from the driven roller 48 and the driving roller 42. The optical detection unit 53 acquires an optical reflection pattern and transmission pattern of the bank note BL. Further, the bank note BL is transported in the rear direction by the driving force from the driven roller 48 and the driving roller 42, pushes up the driven roller 46 in an up direction, and the bank note BL is caught between the driving roller 40 and the driven roller 46. The bank note BL is pushed in a down direction towards the driving roller 40 by the driven roller 46, and the driving force in the rear direction is transmitted.

The bank note BL is transported to the magnetic sensor 52 by the driving force from the driven roller 46 and the driving roller 40. The magnetic sensor reading surface 52A is arranged in the vicinity of the upper side of the conveyance path 32, and the magnetic gap roller outer peripheral surface 54F is arranged by leaving a slight clearance with respect to this magnetic sensor reading surface 52A, thereby making the bank note BL pass through the vicinity of the magnetic sensor reading surface 52A.

In this way, the determination unit 18 can improve a Signal/Noise (S/N) ratio of data to be acquired by the magnetic sensor 52, and can perform a discrimination process with a high accuracy.

The bank note BL is transported in the rear direction by the driving force from the magnetic gap roller 54, pushes up the driven roller 44 in an up direction, and the bank note BL is caught between the driving roller 38 and the driven roller 44. The bank note BL is pushed in a down direction towards the driving roller 38 by the driven roller 44, and the driving force in the rear direction is transmitted.

Figure 18A:
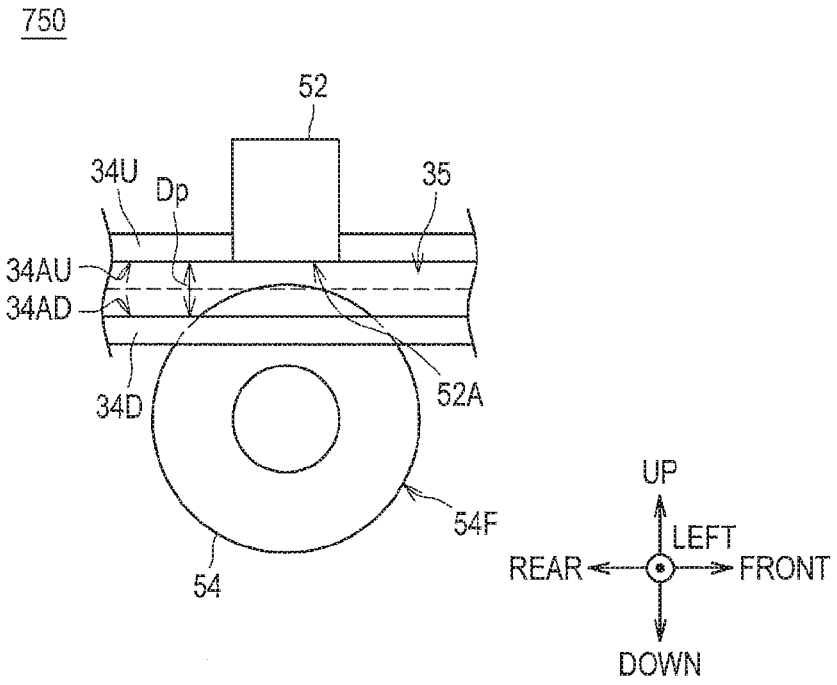
FIG. 18A is a left-side view that shows an example of a configuration of a conventional magnetic detection unit.

Here, the magnetic sensor reading surface 52A of the magnetic sensor 52 will sometimes be provided in the vicinity of the upper side transportation surface 34AU so as not to project into the bank note transportation space 35, and the magnetic gap roller 54 will be arranged by leaving a slight clearance with respect to this magnetic sensor reading surface 52A, such as in a conventional magnetic detection unit 750 shown in FIG. 18A.

Figure 18B:
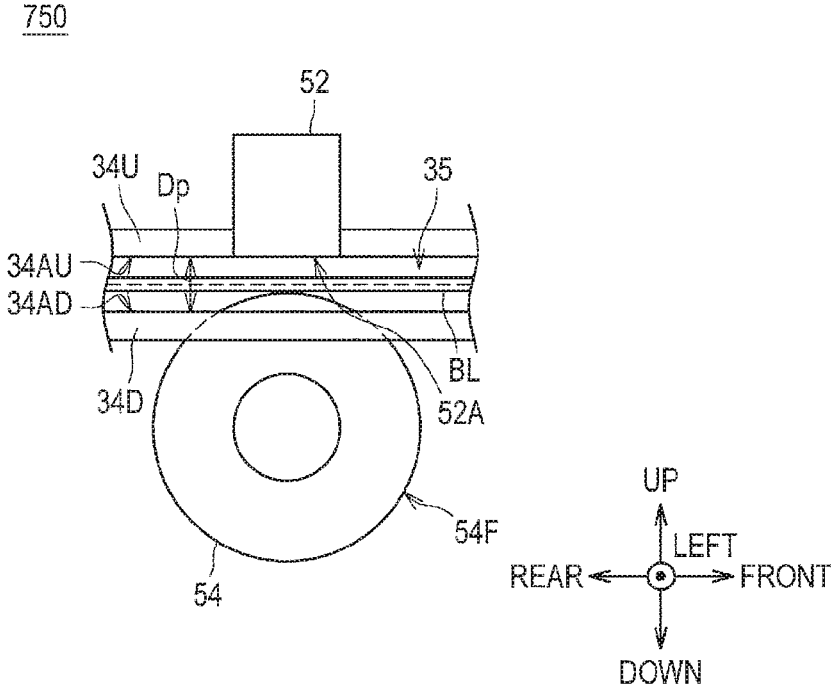
FIG. 18B is a left-side view that shows another example of the configuration of the conventional magnetic detection unit.
Figure 18C:
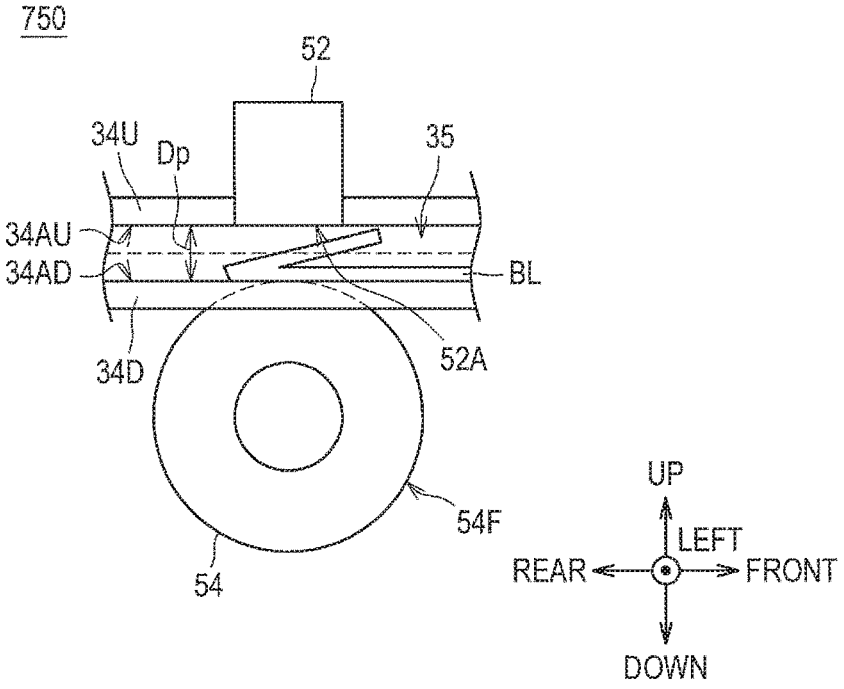
FIG. 18C is a left-side view that shows yet another example of the configuration of the conventional magnetic detection unit.

In the magnetic detection unit 750, in the case where an abnormal bank note has been transported, where a portion exists that is thicker than the gap between the magnetic sensor reading surface 52A and the magnetic gap roller outer peripheral surface 54F because a bank note is folded or a plurality of bank notes overlap with each other, a space with a transportation space thickness, which is the thickness of the bank note transportation space 35 through which a bank note can travel, equal to the distance Dp between transportation surfaces will be formed between the magnetic gap roller 54 and the magnetic sensor reading surface 52A, by having the magnetic gap roller 54 in contact with the bank note BL retract up to the lower side transportation surface 34AD, such as shown in FIG. 18C, and so that the transportation performance can be secured.

However, in the magnetic detection unit 750, in the case where a normal bank note has been transported, which is not folded or the like, the bank note BL will travel through the conveyance path 32 set in the center of the bank note transportation space 35, and will push down the magnetic gap roller 54 to the lower side, such as shown in FIG. 18B. At this time, a large clearance will exist between the bank note BL and the magnetic sensor reading surface 52A. In this way, since the bank note BL travels at a position separated from the magnetic sensor reading surface 52A, the magnetic detection unit 750 will fail to obtain a favorable discrimination performance.

Figure 19A:
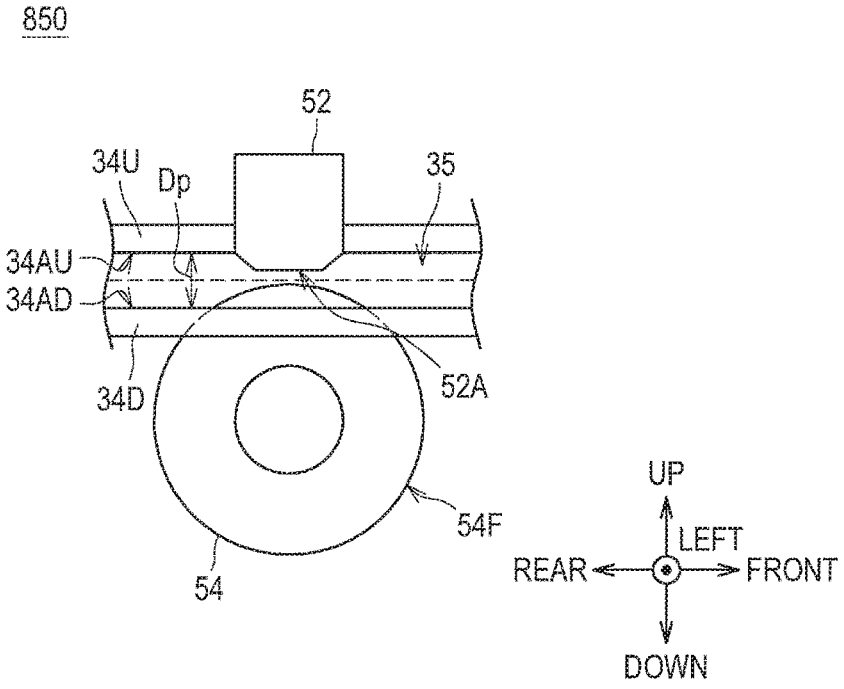
FIG. 19A is a left-side view that shows an example of a configuration of a conventional magnetic detection unit.

In contrast to this, the magnetic sensor reading surface 52A of the magnetic sensor 52 will sometimes be provided so as to project into the bank note transportation space 35, such as in a conventional magnetic detection unit 850 shown in FIG. 19A.

Figure 19B:
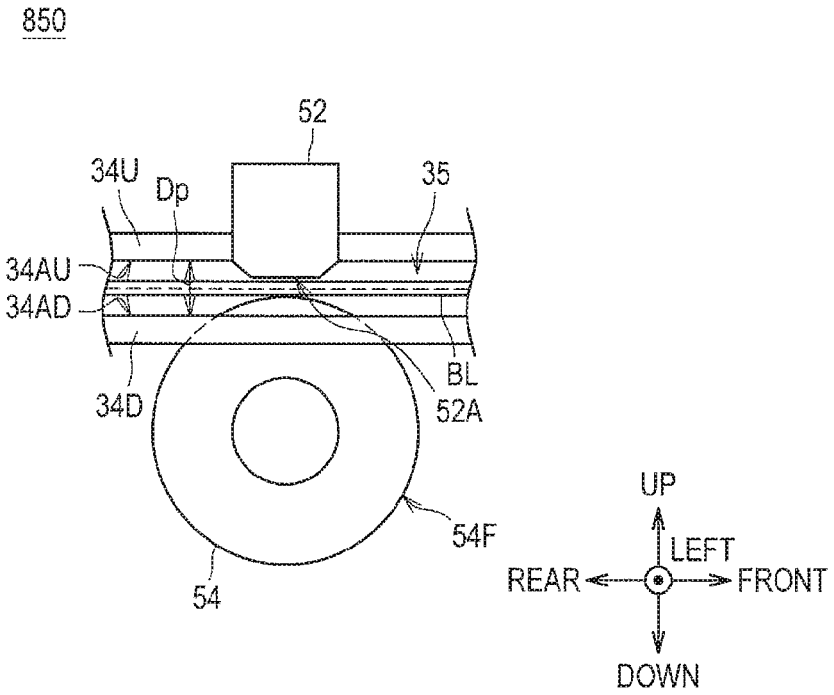
FIG. 19B is a left-side view that shows another example of the configuration of the conventional magnetic detection unit.

In the magnetic detection unit 850, in the case where a normal bank note has been transported, the bank note BL will travel through the conveyance path 32 set in the center of the bank note transportation space 35, and will push down the magnetic gap roller 54 to the lower side, such as shown in FIG. 19B. At this time, there will only be a slight clearance between the bank note BL and the magnetic sensor reading surface 52A. Accordingly, since the bank note BL can be made to travel at a position in the vicinity of the magnetic sensor reading surface 52A, the magnetic detection unit 850 can obtain a favorable discrimination performance.

Figure 19C:
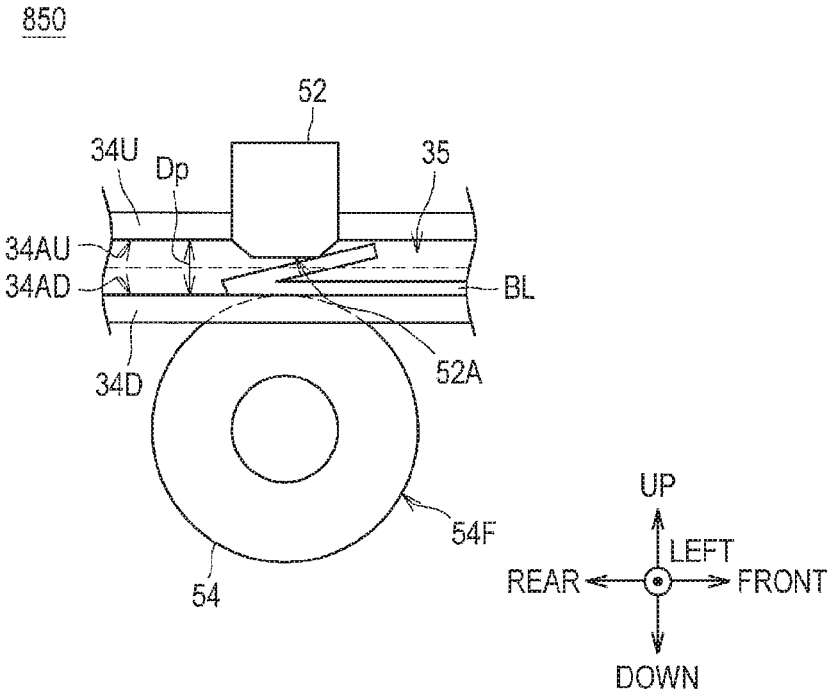
FIG. 19C is a left-side view that shows yet another example of the configuration of the conventional magnetic detection unit.

However, in the magnetic detection unit 850, in the case where an abnormal bank note has been transported, the bank note BL will only be able to push down the magnetic gap roller 54 up to the lower side transportation surface 34AD, such as shown in FIG. 19C, and so that only a space with a transportation space thickness narrower than the distance Dp between transportation surfaces will be formed between the magnetic gap roller 54 and the magnetic sensor reading surface 52A, and the bank note BL will be jammed, and a favorable transportation performance will not be obtained.

In contrast to this, the magnetic detection unit 50 according to the present embodiment has the portion facing the magnetic sensor reading surface 52A, on the lower side transportation guide 34D, separated from this magnetic sensor reading surface 52A, by having this portion bent in a down direction, which is a direction orthogonal to the transportation direction of a bank note, more than the portion not facing the magnetic sensor reading surface 52A.

Figure 8:
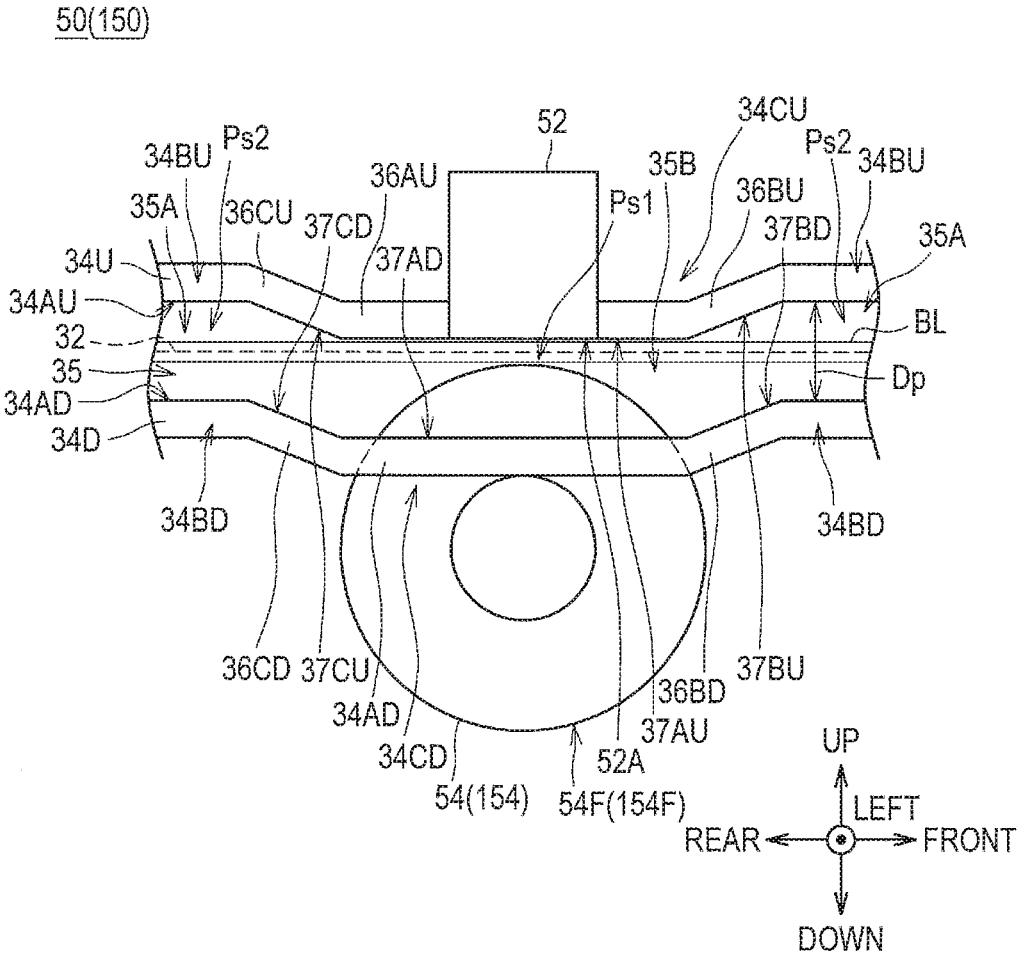
FIG. 8 is a left-side view that shows a configuration (2) of the magnetic detection unit.

In the magnetic detection unit 50, in the case where a normal bank note has been transported, the bank note BL, which travels through the conveyance path 32 positioned approximately in the center of the up-down position of the bank note transportation space 35 at the sensor reading surface non-arrangement position Ps2, is transported in the vicinity of the magnetic sensor reading surface 52A at the sensor reading surface arrangement position Ps1, that is, at a position where a favorable S/N ratio can be obtained while preventing rubbing due to contact with the magnetic sensor reading surface 52A, such as shown in FIG. 8. In this way, the magnetic detection unit 850 can obtain a favorable discrimination performance.

Figure 9:
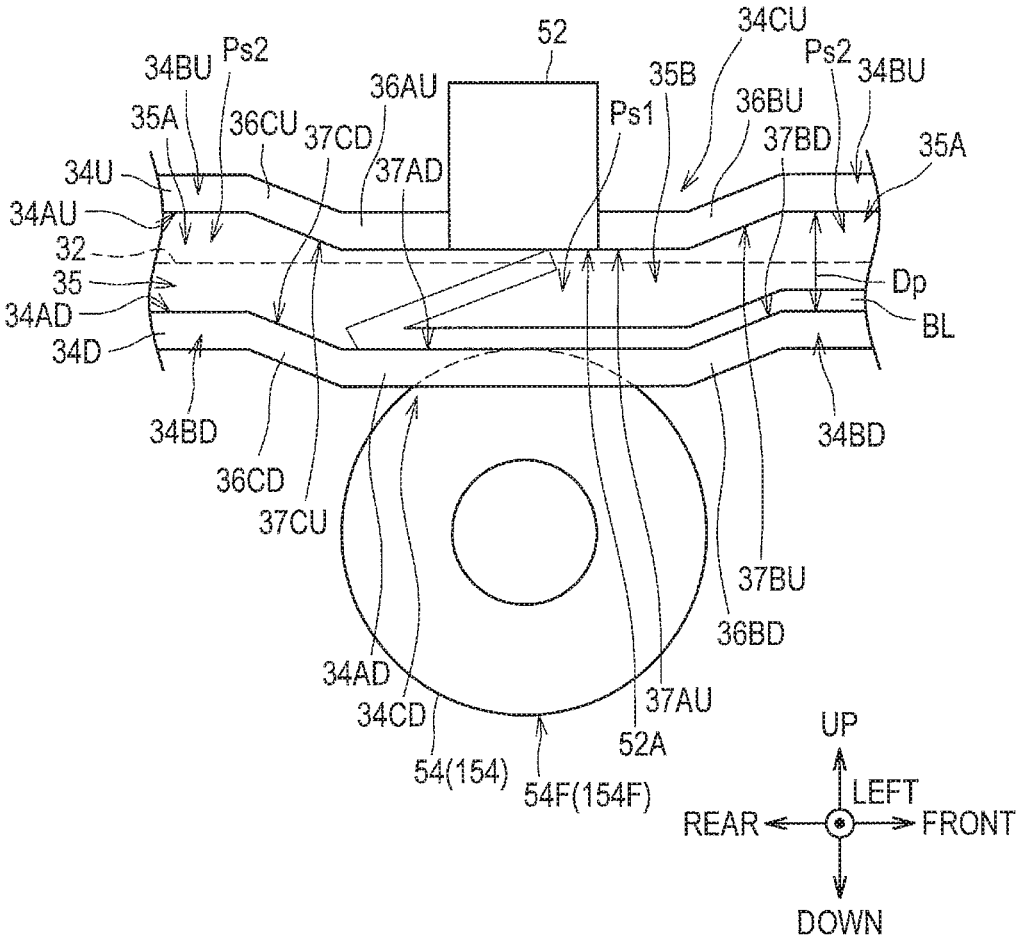
FIG. 9 is a left-side view that shows a configuration (3) of the magnetic detection unit.

On the other hand, in the magnetic detection unit 50, in the case where a bank note has been transported, which is, for example, slightly turned up, twisted, or wrinkled, this bank note will have the shape corrected while being transported, so as to fit in the gap between the magnetic sensor reading surface 52A and the magnetic gap roller outer peripheral surface 54F, by having the magnetic gap roller 54 in contact with the bank note add a load in an up direction with respect to this bank note. Further, in the magnetic detection unit 50, in the case where an abnormal bank note has been transported, the magnetic gap roller 54 in contact with the bank note BL will retract up to the lower side horizontal surface 37AD and cause this bank note BL to be transported, at the time when moving up to the lowest side, such as shown in FIG. 9. In this way, since a space with a transportation space thickness equal to the distance Dp between transportation surfaces will be formed between the magnetic gap roller 54 and the magnetic sensor reading surface 52A, the magnetic detection unit 50 can obtain a favorable transportation performance.

In this way, the determination unit 18 can accommodate both a favorable discrimination performance and a favorable transportation performance.

Further, the driving roller 43 and the driven roller 49, the driving roller 42 and the driven roller 48, the driving roller 40 and the driven roller 46, and the driving roller 38 and the driven roller 44 are arranged so that each other's distances of the front-rear direction are shorter than the length of the shorter side direction of a bank note. Accordingly, at the time when bank note information of the bank note BL is read in the thickness detection unit 60, the optical detection unit 53, and the magnetic detection unit 50, the determination unit 18 can be set in a state where the bank note BL is reliably held by a front-end facing combination of any of the driving roller 43 and the driven roller 49, the driving roller 42 and the driven roller 48, the driving roller 40 and the driven roller 46, and the driving roller 38 and the driven roller 44. In this way, the determination unit 18 can stably read bank note information during a sensor passage, and can perform a discrimination process with a high accuracy.

In addition, the determination unit 18 arranges the driving rollers 40 and 42 made of rubber-based materials at rollers the closest to the front-rear direction of the optical detection unit 53. In this way, since the driving rollers 40 and 42, which are rubber-based rollers, have a higher frictional force with respect to a bank note than that of a metallic roller such as the standard roller 56, the determination unit 18 can reduce the load at the time when the bank note pushes up the driven rollers 46 and 48, can reduce variations in the bank note at the time when the bank note is read in the optical detection unit 53, and can perform a discrimination process with a high accuracy.

Note that, while a description has been made heretofore for an operation in the case where a bank note is transported from the front side towards the rear side, in the case where a bank note is transported from the rear side towards the front side, the rotation direction of each roller or the like will be reversed.

According to the above described configuration, the determination unit 18 includes an upper side transportation guide 34U, disposed on one side of a conveyance path 32 through which a medium serving as a bank note travels when being transported, on which an upper side transportation surface 34AU is formed facing the conveyance path 32, a magnetic sensor 52 on which a magnetic sensor reading surface 52A that reads a state of the bank note is provided closer to the side of the upper side transportation guide 34U than the conveyance path 32, and a lower side transportation guide 34D, disposed on the other side of the conveyance path 32 facing the upper side transportation guide 34U across the conveyance path 32, on which a lower side transportation surface 34AD is formed facing the conveyance path 32, wherein a bank note transportation space 35 through which the bank note is transported is formed between the lower side transportation guide 34D and the upper side transportation guide 34U, and on which a lower side bend part 34CD serving as a bend part is formed, at a portion facing the magnetic sensor reading surface 52A, bent in a direction separating from the magnetic sensor reading surface 52A more than a portion not facing the magnetic sensor reading surface 52A. In this way, the determination unit 18 can secure a transportation space thickness at a portion facing the magnetic sensor reading surface 52A, while bringing a bank note close to the magnetic sensor reading surface 52A, and can enhance the reliability while improving the discrimination performance.

2. Second Embodiment

2-1. Configuration of the Bank Note Deposit-Withdrawal Machine

As shown in FIG. 1 and FIG. 2, compared to the bank note deposit-withdrawal machine 10 of the automatic teller machine 1 according to the first embodiment, a bank note deposit-withdrawal machine 110 of an automatic teller machine 101 according to a second embodiment has a determination unit 118 that is different from the determination unit 18, and the units other than this are configured similarly.

2-2. Configuration of the Determination Unit

As shown in FIG. 3, compared to the determination unit 18 according to the first embodiment, the determination unit 118 according to the second embodiment has a magnetic gap roller 154 of a magnetic detection unit 150 that is different from the magnetic gap roller 54 of the magnetic detection unit 50, and the units other than this are configured similarly.

Figure 10:
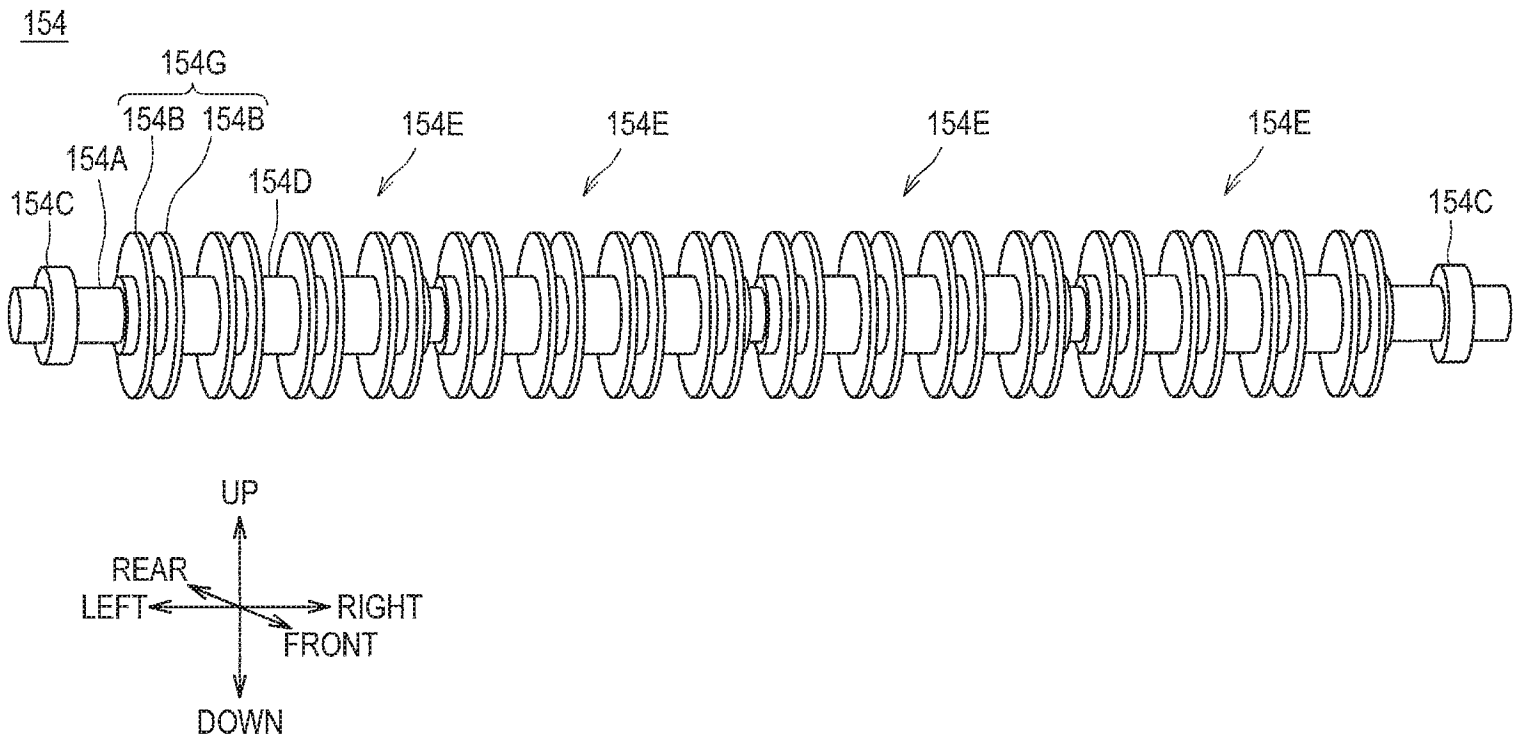
FIG. 10 is a perspective view that shows a configuration of a magnetic gap roller according to the second embodiment.

As shown in FIG. 10, the magnetic gap roller 154 has a boss member 154D of a plurality of roller members 154E, and a rotating shaft 154C capable of rotating with a center axis facing a left-right direction, attached to a shaft 154A made of a non-magnetic material such as an austenitic stainless steel. In the roller members 154E, four sets of a roller set 154G are integrated with the boss member 154D of a rubber-based elastic member such as vulcanized rubber, and these roller sets 154G are arranged by having two rollers 154B, which are rubber-based elastic members such as vulcanized rubber and disk-shaped with a width of approximately 2 mm, for example, leave a gap approximately the same as the width of the left-right direction of the roller 54B (FIG. 5).

The magnetic gap roller 154 is movably attached, in an up-down direction, to the lower side transportation guide 34D facing the magnetic sensor reading surface 52A. In the magnetic gap roller 154, the rotating shaft 154C is pushed towards the upper side by compression springs, which are not illustrated, and the rotating shaft 154C is abutting a limiter (not illustrated) provided on the determination unit housing 30 or the magnetic detection unit 50, so that a clearance between the magnetic gap roller outer peripheral surface 154F of the roller 154B and the magnetic sensor reading surface 52A becomes approximately 0.2 to 0.5 mm (approximately two to five times as thick as a bank note).

2-3. Operation and Effect

In the above configuration, the determination unit 118 reads bank note information by the thickness detection unit 60, the optical detection unit 53, and the magnetic sensor 52 by performing an operation similar to that of the determination unit 18.

Here, since a bank note is printed with ink having a magnetic response, ink having a magnetic response will sometimes adhere to the surface of the magnetic gap roller 154, at the time when the bank note is transported.

In contrast to this, since the magnetic gap roller 154 is constituted by the plurality of rollers 154B with a disk shape thinner than the magnetic gap roller 54, the surface area exposed to the conveyance path 32 becomes smaller than that of the roller 54B. Accordingly, the possibility that ink having a magnetic response adheres to the roller 154B will become smaller than that of the roller 54B. Accordingly, the determination unit 118 can reduce the possibility for misdetecting the rotation of the magnetic gap roller 154 as a magnetic response, and can acquire data of the magnetic sensor 52 with a higher accuracy.

Further, since the magnetic gap roller 154 can reduce the frictional force to a bank note more than the magnetic gap roller 54 does, the possibility that a bank note is caught in the hole parts bored into the lower side transportation surface 34AD can be reduced, at the time of rotating.

Additionally, the determination unit 118 according to the second embodiment accomplishes an operation effect approximately similar to that of the determination unit 18 according to the first embodiment.

3. Third Embodiment

3-1. Configuration of the Bank Note Deposit-Withdrawal Machine

As shown in FIG. 1 and FIG. 2, compared to the bank note deposit-withdrawal machine 10 of the automatic teller machine 1 according to the first embodiment, a bank note deposit-withdrawal machine 210 of an automatic teller machine 201 according to a third embodiment has a determination unit 218 that is different from the determination unit 18, and the units other than this are configured similarly.

3-2. Configuration of the Determination Unit

Figure 11:
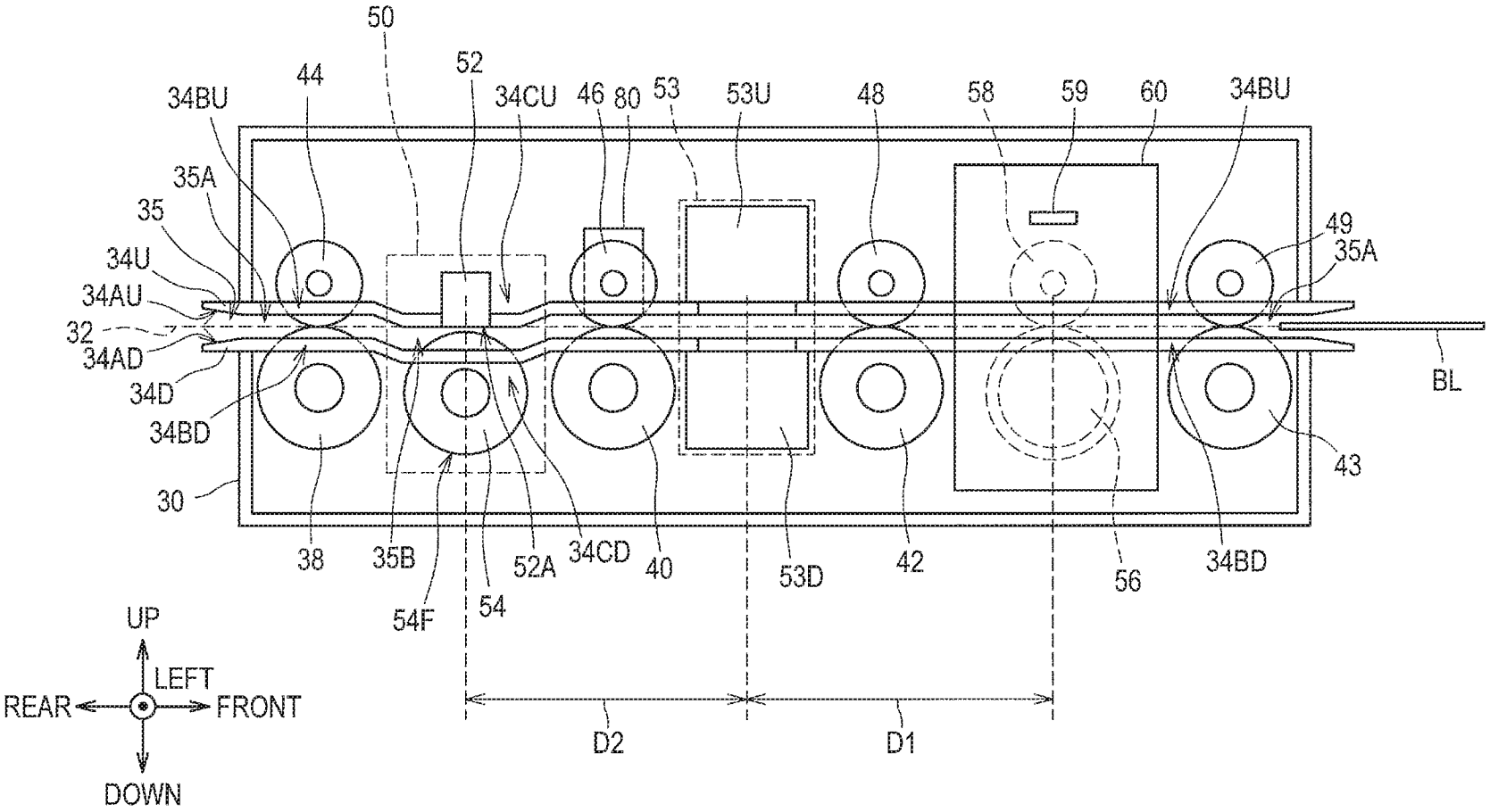
FIG. 11 is a left-side view that shows a configuration of a determination unit according to a third embodiment.
Figure 12:
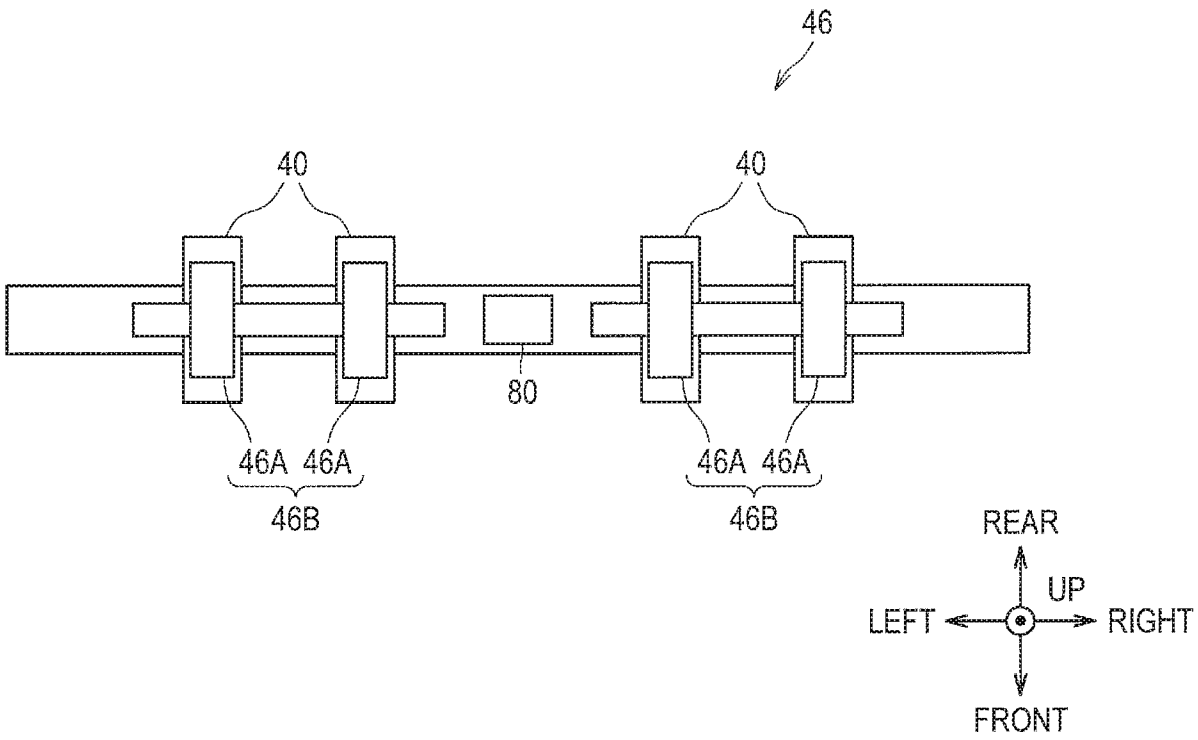
FIG. 12 is a plan view that shows a configuration of a spot reflection detection unit according to the third embodiment.

As shown in FIG. 11 and FIG. 12, compared to the determination unit 18 according to the first embodiment, the determination unit 218 according to the third embodiment additionally has a spot reflection detection unit 80, and the units other than this are configured similarly.

The driven roller 46 has roller sets 46B, which have two rollers 46A as one set, each of which is disposed on the left and right sides. Since the driven roller 46 obtains a driving force from the facing driving roller 40, the left-right roller sets 46B are not connected by a center axis. The spot reflection detection unit 80 is a sensor that acquires a fluorescent response, and is fixed to the determination unit housing 30 so that a reading part on the upper side of the center axis of the driving roller 40 between the roller sets 46B faces the direction of the conveyance path 32.

Figure 13:
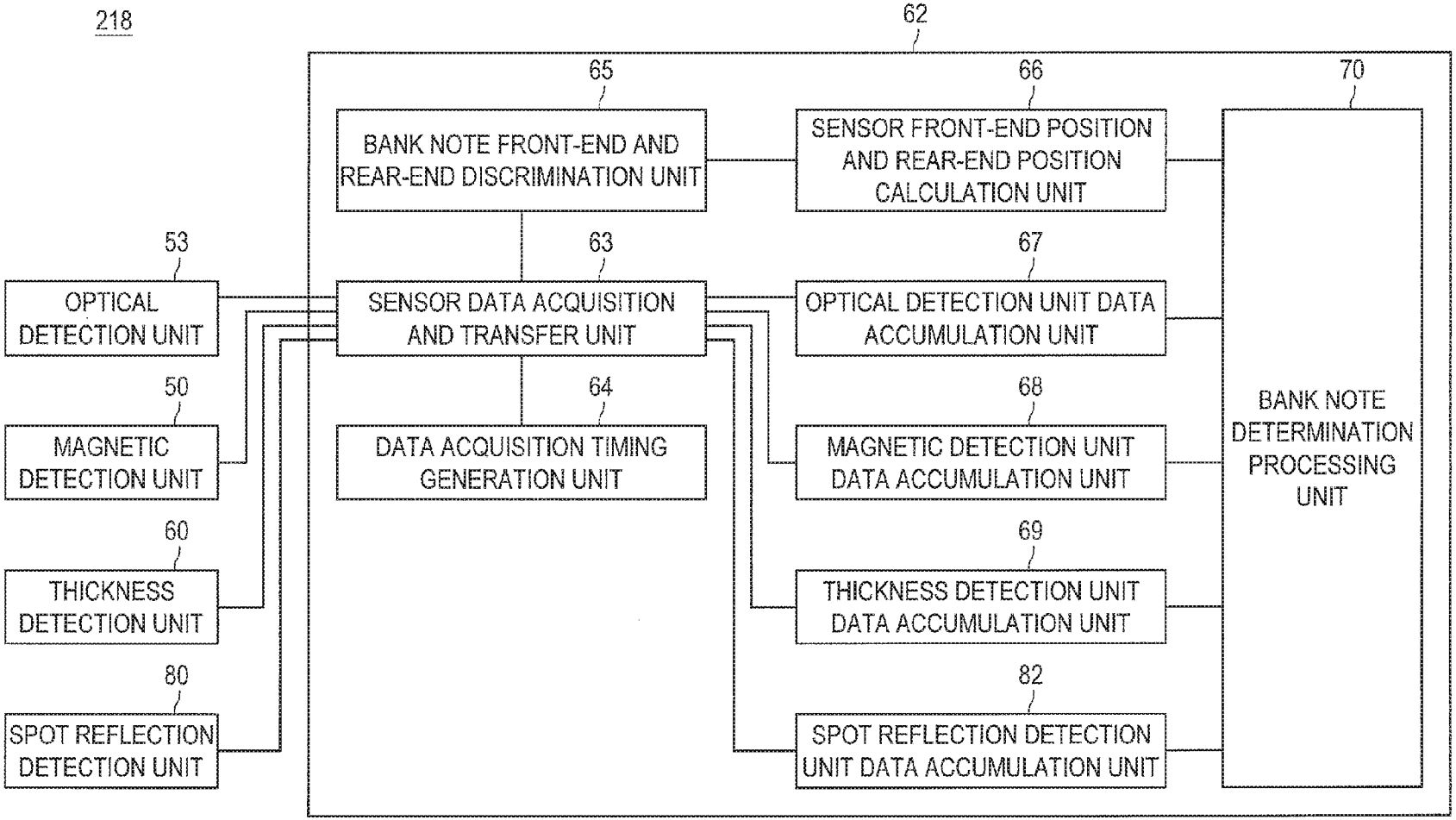
FIG. 13 is a block diagram that shows a function configuration of the determination unit according to the third embodiment.

As shown in FIG. 13, compared to the determination unit 18 (FIG. 6), the determination unit 218 additionally has the spot reflection detection unit 80 and a spot reflection detection unit data accumulation unit 82 as shown in FIG. 6. The spot reflection detection unit data accumulation unit 82 is configured so that data transferred from the sensor data acquisition and transfer unit 63 can be accumulated, and can be read by the bank note determination processing unit 70.

3-3. Operation and Effect

In the above configuration, the determination unit 218 reads bank note information by the thickness detection unit 60, the optical detection unit 53, and the magnetic sensor 52 by performing an operation similar to that of the determination unit 18.

The determination unit 218 acquires data by the spot reflection detection unit 80 at the time when a bank note passes through the conveyance path 32 of the lower side of this spot reflection detection unit 80 and transfers the data to the spot reflection detection unit data accumulation unit 82 by the sensor data acquisition and transfer unit 63, in a similar way the data is acquired at the time when the thickness detection unit 60, the optical detection unit 53, and the magnetic sensor 52 read data of the bank note.

Further, the determination unit 218 calculates a front-end timing and a rear-end timing of the bank note in the spot reflection detection unit 80 by the sensor front-end position and rear-end position calculation unit 66, by using a distance between the spot reflection detection unit 80 and the optical detection unit 53, acquires data of a range from the front-end timing up to the rear-end timing by the bank note determination processing unit 70 from the spot reflection detection unit data accumulation unit 82, and performs a discrimination process of the bank note in conjunction with the data acquired from the optical detection unit data accumulation unit 67, the magnetic detection unit data accumulation unit 68, and the thickness detection unit data accumulation unit 69.

Since the spot reflection detection unit 80 is a sensor that acquires a fluorescent response, the output will change greatly due to the position of an up-down direction of the bank note. In contrast to this, the spot reflection detection unit 80 is arranged so as to overlap with the driven roller 46 in a side view. In this way, since the bank note read by the spot reflection detection unit 80 is caught between the driving roller 40 and the driven roller 46, the position of the up-down direction will be stable in the conveyance path 32.

In this way, the determination unit 218 can read bank note information with a higher accuracy, and can perform a discrimination process of a bank note with a high accuracy by using data acquired from the spot reflection detection unit 80 in addition to data acquired from the optical detection unit 53, the thickness detection unit 60, and the magnetic detection unit 50.

4. Other Embodiments

Figure 14:
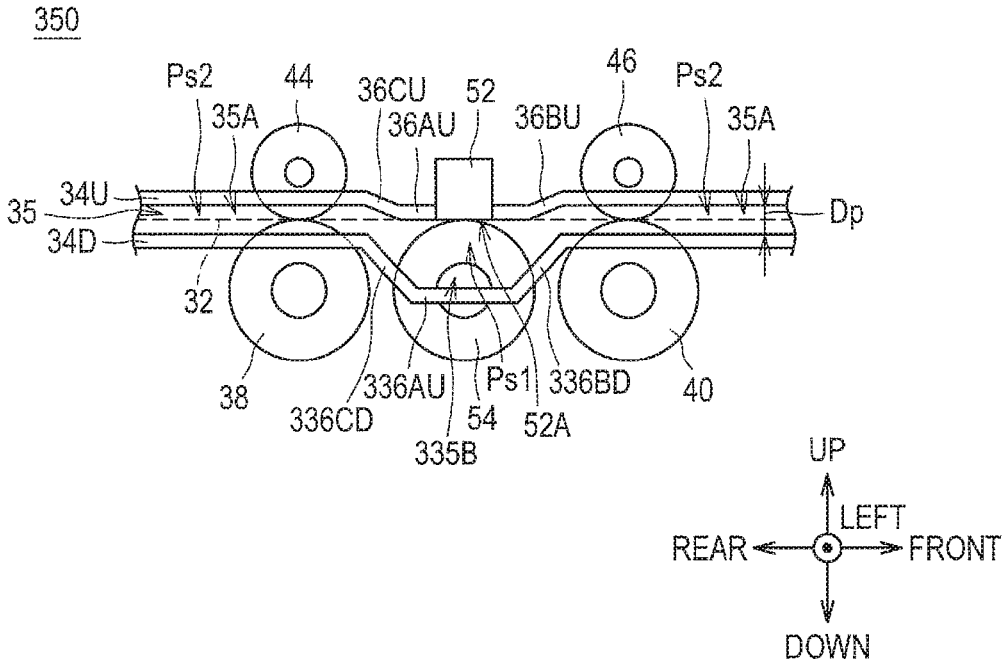
FIG. 14 is a left-side view that shows a configuration (1) of a magnetic detection unit according to another embodiment.

Note that, in the above described embodiments, a case has been described where the distance Dp between transportation surfaces is approximately constant, at both the sensor reading surface non-arrangement position Ps2 and the sensor reading surface arrangement position Ps1. The present invention is not limited to this, and the distance Dp between transportation surfaces of the sensor reading surface arrangement position Ps1 may be made larger than the distance Dp between transportation surfaces of the sensor reading surface non-arrangement position Ps2, by separating the position of a lower side horizontal part 336AD from the magnetic sensor reading surface 52A more than the lower side horizontal part 36AD, such as in a transportation space bend part 335B of a magnetic detection unit 350 shown in FIG. 14. In this case, since the magnetic gap roller 54 can be greatly retracted to the lower side than the magnetic detection unit 50, a bank note can be more stably transported.

Figure 15:
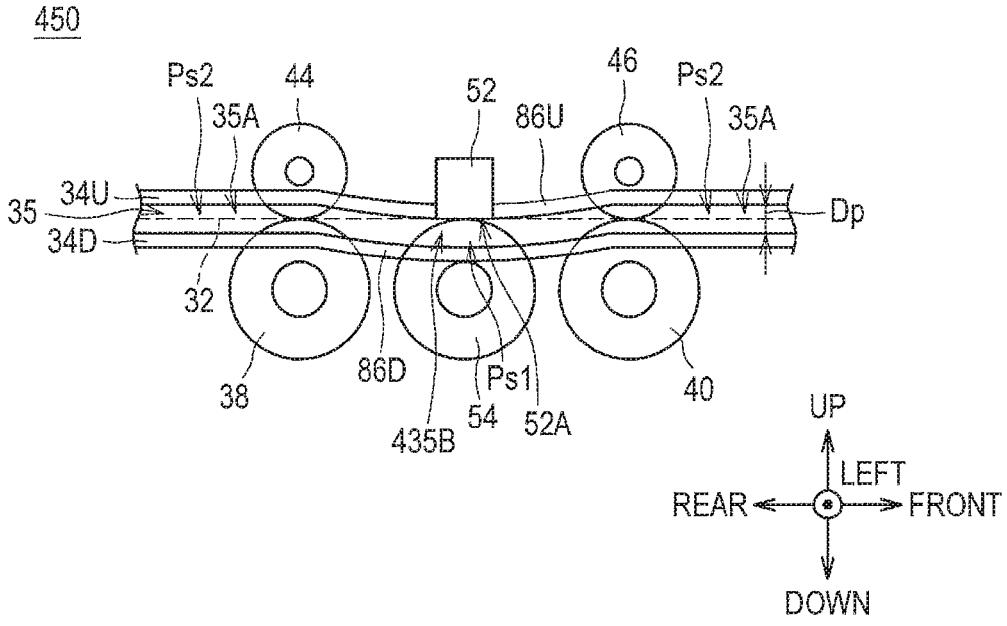
FIG. 15 is a left-side view that shows a configuration (2) of a magnetic detection unit according to another embodiment.

Further, in the above described embodiments, a case has been described where the transportation space bend part 35B is formed by the planar upper side horizontal part 36AU, upper side front inclination part 36BU, upper side rear inclination part 36CU, lower side horizontal part 36AD, lower side front inclination part 36BD, and lower side rear inclination part 36CD. The present invention is not limited to this, and a transportation space bend part 435B may be constituted by an upper side curve part 86U and a lower side curve part 86D curved facing downward, and the lower side curve part 86D may be separated from the magnetic sensor reading surface 52A, such as in a magnetic detection unit 450 shown in FIG. 15. That is, the lower side transportation surface 34AD facing the magnetic sensor reading surface 52A may be separated from the magnetic sensor reading surface 52A.

Figure 16:
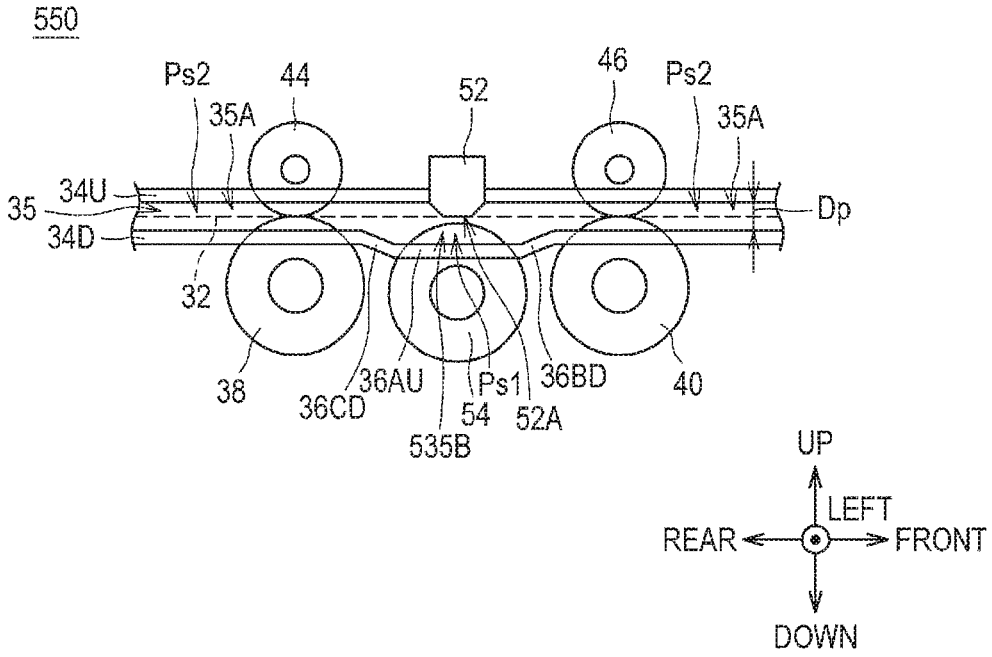
FIG. 16 is a left-side view that shows a configuration (3) of a magnetic detection unit according to another embodiment.

In addition, in the above described embodiment, a case has been described where the magnetic sensor reading surface 52A does not project into the bank note transportation space 35. The present invention is not limited to this, and the upper side rear inclination part 36CU, the upper side horizontal part 36AU, and the upper side front inclination part 36BU do not have to be formed in the upper side transportation guide 34U, but the magnetic sensor reading surface 52A may project into the bank note transportation space 35 from a hole part bored into this upper side transportation guide 34U, such as in a transportation space bend part 535B of the magnetic detection unit 550 shown in FIG. 16. In this case, when the corners of the front-rear direction of the magnetic sensor reading surface 52A are planed off, it will be difficult for a bank note to be caught on this magnetic sensor reading surface 52A.

Figure 17:
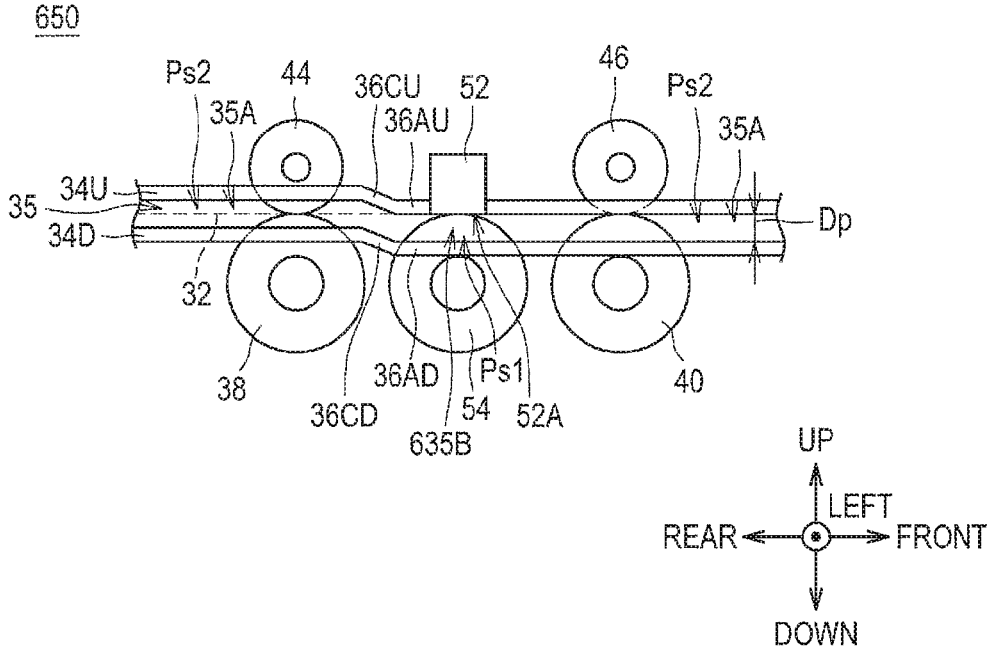
FIG. 17 is a left-side view that shows a configuration (4) of a magnetic detection unit according to another embodiment.

In addition, in the above described embodiments, a case has been described where the present invention is applied to the determination units 18, 118, and 218 that transport a bank note in a front-rear direction. The present invention is not limited to this, and in the case of a determination unit only transporting a bank note in one direction from the front towards the rear or from the rear towards the front, the upper side rear inclination surface 37CU and the lower side rear inclination surface 37CD, and the upper side horizontal surface 37AU and the lower side horizontal surface 37AD may be formed from upstream (the rear) towards downstream (the front) of the transportation direction of a bank note, and the upper side front inclination surface 37BU and the upper side front inclination surface 37BU do not have to be formed, such as shown in FIG. 17 for a transportation space bend part 635B of a magnetic detection unit 650 of a determination unit that transports a bank note in one direction, for example, from the rear towards the front.

In addition, in the above described embodiments, a case has been described where the distance Dp between transportation surfaces is approximately constant at both the sensor reading surface non-arrangement position Ps2 and the sensor reading surface arrangement position Ps1. The present invention is not limited to this, and the sensor reading surface arrangement position Ps1 may have a narrower distance Dp between transportation surfaces than the sensor reading surface non-arrangement position Ps2. That is, the lower side transportation surface 34AD at the sensor reading surface arrangement position Ps1 may be separated from the magnetic sensor reading surface 52A in an up-down direction more than the lower side transportation surface 34AD at the sensor reading surface non-arrangement position Ps2.

In addition, in the above described embodiments, a case has been described where the magnetic detection unit 50, the optical detection unit 53, and the thickness detection unit 60 are arranged in order from the rear towards the front, and a discrimination process is performed. The present invention is not limited to this, and the magnetic detection unit 50, the optical detection unit 53, and the thickness detection unit 60 may be arranged at any positions, and a magnetic detection unit front-end timing and a magnetic detection unit rear-end timing, and a thickness detection unit front-end timing and a thickness detection unit rear-end timing may be calculated based on an optical detection unit front-end timing and an optical detection unit rear-end timing, and data of the magnetic detection unit and the thickness detection unit may be acquired.

In addition, in the above described first embodiment, a case has been described where the determination unit 18 performs a discrimination process. The present invention is not limited to this, and the control unit 12 may control the determination unit 18, or a discrimination process may be performed by having the determination unit 18 and the control unit 12 operate cooperatively. The same applies to the second and third embodiments.

In addition, in the above described embodiments, a case has been described where the rollers 54B and 154B are made of vulcanized rubber. The present invention is not limited to this, and the rollers 54B and 154B may be made of, for example, a thermoplastic elastomer or the like. In this case, a sink mark at the time of formation can be reduced, and the cost can be reduced. That is, they may be rollers made of various materials that can contact with a transported bank note and be brought close to the magnetic sensor.

In addition, in the above described third embodiment, a case has been described where the spot reflection detection unit 80 is arranged so as to overlap with the driven roller 46. The present invention is not limited to this, and it may be arranged at any one of the driven rollers 44, 46, 48, and 49, or a combination thereof.

In addition, in the above described third embodiment, while the spot reflection detection unit 80 is provided, the present invention is not limited to this, and various sensors that detect a state of a bank note may be provided.

In addition, in the above described embodiments, a case has been described where the present invention is applied to the determination units 18, 118, and 218 that cause a bank note to travel in a front-rear direction along the approximately horizontal conveyance path 32. The present invention is not limited to this, and the present invention may be applied to a determination unit that causes a bank note to travel in various directions, such as causing a bank note to travel in an up-down direction along an approximately vertical conveyance path.

In addition, in the above described embodiments, a case has been described where the present invention is applied to the determination units 18, 118 and 218 that determine the denomination and authenticity of a bank note. The present invention is not limited to this, and the present invention may be applied to a portion having various sensors, conveyance paths, and rollers provided in the bank note deposit-withdrawal machines 10, 110 and 210.

In addition, in the above described embodiments, a case has been described where the present invention is applied to a determination unit that determines the bank note BL serving as a medium, in the automatic teller machines 1, 101, and 201 that perform a transaction of cash. The present invention is not limited to this, and may be applied to various apparatuses that determine, for example, a thin paper-shaped medium such as a claim, a bond, a gift certificate, a voucher, or an admission ticket.

Further, for example, the present invention may be applied to a cash processing apparatus constituted by a combination of a plurality of types of apparatuses that perform various processes related to transactions of bank notes or coins, such as a bank note deposit-withdrawal machine that accepts and pays out bank notes, or a wrapping and small bundle paying machine that wraps bank notes for each prescribed number of notes.

In addition, in the above described embodiments, while a case has been described where the present invention is applied to an automatic teller machine that performs a deposit transaction and a withdrawal transaction, the present invention may be applied to an apparatus that performs only one of a deposit transaction and a withdrawal transaction.

In addition, in the above described embodiments, a case has been described where the determination units 18, 118 or 218 serving as a determination apparatus is constituted by the upper side transportation guide 34U serving as a one side transportation guide, the lower side transportation guide 34D serving as an other side transportation guide, and the magnetic sensor 52 serving as a sensor. The present invention is not limited to this, and a determination apparatus may be constituted by a one side transportation guide, an other side transportation guide, and a sensor having various types of configurations other than this.

In addition, in the above described embodiments, a case has been described where the bank note deposit-withdrawal machines 10, 110, and 210 serving as a medium transaction apparatus are constituted by the customer service unit 3 serving as an operation unit, the conveyance path 32 serving as a transportation unit, the upper side transportation guide 34U serving as a one side transportation guide, the lower side transportation guide 34D serving as an other side transportation guide, and the magnetic sensor 52 serving as a sensor. The present invention is not limited to this, and a medium transaction apparatus may be constituted by an operation unit, a transportation unit, a one side transportation guide, an other side transportation guide, and a sensor having various types of configurations other than this.

INDUSTRIAL APPLICABILITY

The present invention can be used by various apparatuses that determine a paper-shaped medium such as a bank note.

REFERENCE SIGNS LIST

1, 101, 201 automatic teller machine
2 housing
3 customer service unit
4 card input-output port
5 deposit-withdrawal port
6 operation display unit
7 numeric keypad
8 receipt issue port
9 main control unit
10, 110, 210 bank note deposit-withdrawal machine
12 control unit
16 bank note deposit-withdrawal unit
18, 118, 218 determination unit
20 temporary reservation unit
22 forgotten-bank-note collection storage
24 transportation unit
26 bank note storage
28 rejection storage
30 determination unit housing
32 conveyance path
34U upper side transportation guide
34D lower side transportation guide
34AU upper side transportation surface
34AD lower side transportation surface
34BU upper side straight-line part
34CU upper side bend part
34BD lower side straight-line part
34CD lower side bend part
35 bank note transportation space
35A transportation space straight line part
35B, 335B, 435B transportation space bend part
38, 40, 42, 43 driving roller
44, 46, 48, 49 driven roller
46A roller
46B roller set
36AU upper side horizontal part
36BU upper side front inclination part
36CU upper side rear inclination part
36AD, 336AD lower side horizontal part
36BD, 336BD lower side front inclination part
36CD, 336CD lower side rear inclination part
37AU upper side horizontal surface
37BU upper side front inclination surface
37CU upper side rear inclination surface
37AD lower side horizontal surface
37BD lower side front inclination surface
37CD lower side rear inclination surface
50, 350, 450, 550, 650, 750, 850 magnetic detection unit
52 magnetic sensor
52A magnetic sensor reading surface
53 optical detection unit
53U upper side reflection-transmission sensor unit
53D lower side reflection-transmission sensor unit
54, 154 magnetic gap roller
54A, 154A shaft
54B, 154B roller
54C, 154C rotating shaft
54F, 154F magnetic gap roller outer peripheral surface
154D boss member
154E roller member
154G roller set
56 standard roller
58 thickness detection roller
59 displacement sensor
60 thickness detection unit
62 determination control unit
63 sensor data acquisition and transfer unit
64 data acquisition timing generation unit
65 bank note front-end and rear-end discrimination unit
66 sensor front-end position and rear-end position calculation unit
67 optical detection unit data accumulation unit
68 magnetic detection unit data accumulation unit
69 thickness detection unit data accumulation unit
70 bank note determination processing unit
80 spot reflection detection unit
82 spot reflection detection unit data accumulation unit
86U upper side curve part
86D lower side curve part
Dp distance between transportation surfaces
Ps1 sensor reading surface arrangement position
Ps2 sensor reading surface non-arrangement position
D1 distance between the optical detection unit and thickness detection unit
D2 distance between the optical detection unit and magnetic detection unit
T1 time between the optical detection unit and thickness detection unit
T2 time between the optical detection unit and magnetic detection unit
T3 optical detection unit data acquisition time period
T4 thickness detection unit data acquisition time period
T5 magnetic detection unit data acquisition time period
t1 optical detection unit front-end timing
t2 thickness detection unit front-end timing
t3 magnetic detection unit front-end timing
t4 optical detection unit rear-end timing
t5 thickness detection unit rear-end timing
t6 magnetic detection unit rear-end timing
TP tape
MR1, MR2 magnetically-responsive portion
BL bank note

The invention claimed is:

1. A determination apparatus, comprising:

a one side transportation guide, disposed on one side of a conveyance path through which a medium travels when being transported, on which a one side transportation surface is formed facing the conveyance path;

a sensor on which a reading surface that reads a state of the medium is provided closer to a side of the one side transportation guide than the conveyance path;

an other side transportation guide, disposed on another side of the conveyance path facing the one side transportation guide across the conveyance path, on which an other side transportation surface is formed facing the conveyance path, on which a medium transportation space through which the medium is transported is formed between the other side transportation guide and the one side transportation guide, and on which a bend part is formed, at a portion facing the reading surface, bent in a direction separating from the reading surface more than a portion not facing the reading surface; and a roller disposed facing the reading surface configured to alternatingly move in contact with and separated from the reading surface and to transport the medium by rotating in contact with the medium, such that in a first position in which the roller is separated from the reading surface, an outer peripheral surface of the roller is positioned closer to a side of the other side transportation guide than the conveyance path, wherein the conveyance path is positioned on a line connecting a first contact point and a second contact point, the first contact point is a contact point of a first transportation roller and the medium, the first transportation roller located on an upstream side of the sensor with respect to a transportation direction of the medium along the conveyance path, and the second contact point is a contact point of a second transportation roller and the medium, the second transportation roller located on a downstream side of the sensor with respect to the transportation direction of the medium.

2. The determination apparatus according to claim 1, wherein the roller has a part of the outer peripheral surface exposed on a side of the conveyance path from a hole part bored into the other side transportation guide.

3. The determination apparatus according to claim 2, wherein the roller moves so as to separate from the reading surface when in contact with the medium.

4. The determination apparatus according to claim 3, wherein the roller has the outer peripheral surface move up to the other side transportation surface when in contact with the medium.

5. The determination apparatus according to claim 1, wherein the one side transportation guide and the other side transportation guide are formed with an approximately constant distance between transportation surfaces, which is a distance between the one side transportation surface and the other side transportation surface, at both of the reading surface non-arrangement position and a reading surface arrangement position at which the reading surface is disposed.

6. The determination apparatus according to claim 1, wherein the one side transportation guide has a concave shape, at a reading surface arrangement position where the reading surface is disposed, on the one side transportation guide, so as to be closer to the conveyance path than a reading surface arrangement position where the reading surface is not disposed, and wherein the other side transportation guide has a convex shape, at the reading surface arrangement position on the other side transportation guide, so as to be separated from the conveyance path more than the reading surface arrangement position.

7. The determination apparatus according to claim 1, wherein the reading surface is disposed separated from the conveyance path more than the one side transportation surface.

8. The determination apparatus according to claim 1, wherein the roller is disposed by leaving a clearance approximately two to five times as thick as the medium with respect to the reading surface.

9. The determination apparatus according to claim 1, wherein the roller includes a combination of a plurality of disk-shaped rollers.

10. The determination apparatus according to claim 1, wherein the sensor is a magnetic sensor that detects a magnetism which the medium has.

11. The determination apparatus according to claim 10, further comprising, in addition to the magnetic sensor:

a thickness detection unit that detects a thickness of the medium; and an optical detection unit that optically detects a state of the medium.

12. A medium transaction apparatus, comprising:

an operation unit that receives an operation related to a paper-sheet shaped medium;

a transportation unit that transports the medium;

a one side transportation guide, disposed on one side of a conveyance path through which the medium travels when being transported, on which a one side transportation surface is formed facing the conveyance path;

a sensor on which a reading surface that reads a state of the medium is provided closer to a side of the one side transportation guide than the conveyance path;

an other side transportation guide, disposed on another side of the conveyance path facing the one side transportation guide across the conveyance path, on which an other side transportation surface is formed facing the conveyance path, on which a medium transportation space through which the medium is transported is formed between the one side transportation guide, and on which a bend part is formed, at a portion facing the reading surface, bent in a direction separating from the reading surface more than a portion not facing the reading surface; and a roller disposed facing the reading surface configured to alternatingly move in contact with and separated from the reading surface and to transport the medium by rotating in contact with the medium, such that in a first position in which the roller is separated from the reading surface, an outer peripheral surface of the roller is positioned closer to a side of the other side transportation guide than the conveyance path, wherein the conveyance path is positioned on a line connecting a first contact point and a second contact point, the first contact point is a contact point of a first transportation roller and the medium, the first transportation roller located on an upstream side of the sensor with respect to a transportation direction of the medium along the conveyance path, and the second contact point is a contact point of a second transportation roller and the medium, the second transportation roller located on a downstream side of the sensor with respect to the transportation direction of the medium.

* * * * *